US011003123B2

(12) United States Patent
Sugiyama et al.

(10) Patent No.: US 11,003,123 B2
(45) **Date of Patent: *May 11, 2021**

(54) PRINTING APPARATUS, SHEET HOUSING APPARATUS, AND PRINTER

(71) Applicant: CANON KABUSHIKI KAISHA, Tokyo (JP)

(72) Inventors: Toshiro Sugiyama, Yokohama (JP); Yasuyuki Asai, Tokyo (JP); Hiromasa Yoneyama, Chigasaki (JP); Tetsuo Kikuchi, Ayase (JP); Itaru Wada, Yokohama (JP); Daiki Anayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/929,724

(22) Filed: Jul. 15, 2020

(65) Prior Publication Data

US 2020/0348619 A1 Nov. 5, 2020

Related U.S. Application Data

(63) Continuation of application No. 15/970,190, filed on May 3, 2018, now Pat. No. 10,754,286.

(30) Foreign Application Priority Data

May 12, 2017 (JP) ..... JP2017-095406

(51) Int. Cl.
*B41J 11/00* (2006.01)
*B41J 29/06* (2006.01)
(Continued)

(52) U.S. Cl.
CPC ..... *G03G 15/657* (2013.01); *B41J 11/001* (2013.01); *B41J 13/106* (2013.01); *B41J 15/04* (2013.01); *B65H 31/02* (2013.01); *G03G 21/1609* (2013.01); *B65H 2402/42* (2013.01); *B65H 2405/1116* (2013.01); *B65H 2701/11312* (2013.01); *B65H 2801/36* (2013.01); *G03G 2215/00599* (2013.01)

(58) Field of Classification Search
None
See application file for complete search history.

(56) References Cited

U.S. PATENT DOCUMENTS 8,911,199 B2 12/2014 Herrmann et al.
9,434,189 B2 9/2016 Anayama et al.
(Continued)

FOREIGN PATENT DOCUMENTS

JP 2016-69156 A 5/2016

*Primary Examiner* — Leslie J Evanisko
(74) *Attorney, Agent, or Firm* — Venable LLP

(57) ABSTRACT

A sheet housing apparatus including a housing unit, which houses a sheet to be discharged from a discharging opening of a printer, and a pair of housing-side feet disposed on both sides, in a width direction, of the sheet housing apparatus. The sheet housing apparatus can be combined with the printer. The printer includes a pair of body-side feet disposed on both sides, in the width direction, of the printer. In a state in which the sheet housing apparatus is combined with the printer, the body-side feet and the housing-side feet are arranged not to overlap with each other in the width direction.

18 Claims, 15 Drawing Sheets

(51) Int. Cl.

| | |
|---|---|
| ***B65H 31/22*** | (2006.01) |
| ***G03G 15/00*** | (2006.01) |
| ***B41J 15/04*** | (2006.01) |
| ***B41J 13/10*** | (2006.01) |
| ***G03G 21/16*** | (2006.01) |
| ***B65H 31/02*** | (2006.01) |

(56) References Cited

U.S. PATENT DOCUMENTS

| | | | | |
|---|---|---|---|---|
| 9,580,268 | B2 | 2/2017 | Nagashima et al. | |
| 9,809,407 | B2 | 11/2017 | Anayama et al. | |
| 10,754,286 | B2 | 8/2020 | Sugiyama et al. | |
| 2015/0273897 | A1* | 10/2015 | Kato ..... | B41J 13/106<br>347/104 |
| 2016/0090259 | A1 | 3/2016 | Koda et al. | |
| 2016/0090261 | A1 | 3/2016 | Nagashima et al. | |
| 2017/0088384 | A1 | 3/2017 | Asai et al. | |

* cited by examiner

PRINTING APPARATUS, SHEET HOUSING APPARATUS, AND PRINTER

CROSS-REFERENCE TO RELATED APPLICATIONS

This application is a Continuation of U.S. patent application Ser. No. 15/970,190, filed May 3, 2018, which claims the benefit of Japanese Patent Application No. 2017-095406, filed May 12, 2017, the entire disclosures of which are all hereby incorporated by reference.

BACKGROUND OF THE INVENTION

Field of the Invention

The present invention relates to a printing apparatus, a sheet housing apparatus comprised in the printing apparatus, and a printer comprised in the printing apparatus.

Description of the Related Art

Japanese Patent Laid-Open No. 2016-69156 discloses a sheet housing apparatus (sheet stacker) which can be connected to a printer at the time of use. The sheet housing apparatus receives a printed sheet discharged from the body of the printer and conveys the sheet obliquely upward for stacking. Each of the bodies of the printer and sheet housing apparatus is supported by two columns, and those bodies have a positional relation such that those columns do not interfere with each other.

SUMMARY OF THE INVENTION

In the sheet housing apparatus disclosed in Japanese Patent Laid-Open No. 2016-69156, a printed sheet is to be stacked on an upper position apart from the printer body. In order to ensure a sheet housing space on such a high position, the size of the sheet housing apparatus will be increased, and in particular, the increase will be significant if the size of a sheet is a large one. Accordingly, it is desirable that a lower part of a space at the printer body be used as a housing space for the sheet housing apparatus. In this case, it is desirable to ensure a large housing space while avoiding interference with the columns of the printer and sheet housing apparatus.

The present invention provides a printing apparatus, a sheet housing apparatus, and a printer, in which the increased size of the entire apparatus is suppressed while ensuring a large housing space for sheets.

In a first aspect of the present invention, there is provided a printing apparatus including a printer and a sheet housing apparatus. The printer includes a printing unit which performs printing on a sheet and which discharges a printed sheet from a discharging opening. The sheet housing apparatus includes a housing unit which houses a sheet to be discharged from the discharging opening. The printer also includes a pair of body-side feet disposed on both sides, in a width direction of a sheet to be discharged from the discharging opening, to support the printing unit. The sheet housing apparatus can be mounted from a predetermined mounting direction to the printer and includes a pair of housing-side feet disposed on both sides, in the width direction, to support the housing unit. The body-side feet and the housing-side feet are arranged to be disposed, in a state in which the sheet housing apparatus is mounted to the printer, so as to overlap with each other in the mounting direction and not to overlap with each other in the width direction.

In a second aspect of the present invention, there is provided a sheet housing apparatus which is mounted to a printer from a predetermined mounting direction and which includes a housing unit for housing a sheet to be discharged from a discharging opening of the printer. The printer includes a printing unit which performs printing on a sheet and which discharges a printed sheet from the discharging opening and a pair of body-side feet disposed on both sides, in a width direction of a sheet to be discharged from the discharging opening, to support the printing unit. The sheet housing apparatus includes a pair of housing-side feet disposed on both sides, in the width direction, to support the housing unit. The housing-side feet are arranged to be disposed, in a state in which the sheet housing apparatus is mounted to the printer, so as to overlap with the body-side feet in the mounting direction and not to overlap with the body-side feet in the width direction.

In a third aspect of the present invention, there is provided a printer including a printing unit which performs printing on a sheet and which discharges a printed sheet from a discharging opening and configured to be mounted with a sheet housing apparatus from a predetermined mounting direction. The sheet housing apparatus includes a housing unit which houses a sheet to be discharged from the discharging opening and a pair of housing-side feet disposed on both sides, in a width direction of a sheet to be discharged from the discharging opening, to support the housing unit. The printer includes a pair of body-side feet disposed on both sides, in the width direction, to support the printing unit. The body-side feet are arranged to be disposed, in a state in which the sheet housing apparatus is mounted to the printer, so as to overlap with the housing-side feet in the mounting direction and not to overlap with the housing-side feet in the width direction.

According to the present invention, the increased size of the printing apparatus, the sheet housing apparatus, and printer can be suppressed while ensuring the large housing space for sheets.

DESCRIPTION OF THE EMBODIMENTS

Further features of the present invention will become apparent from the following description of exemplary embodiments with reference to the attached drawings.

Figure 1A:
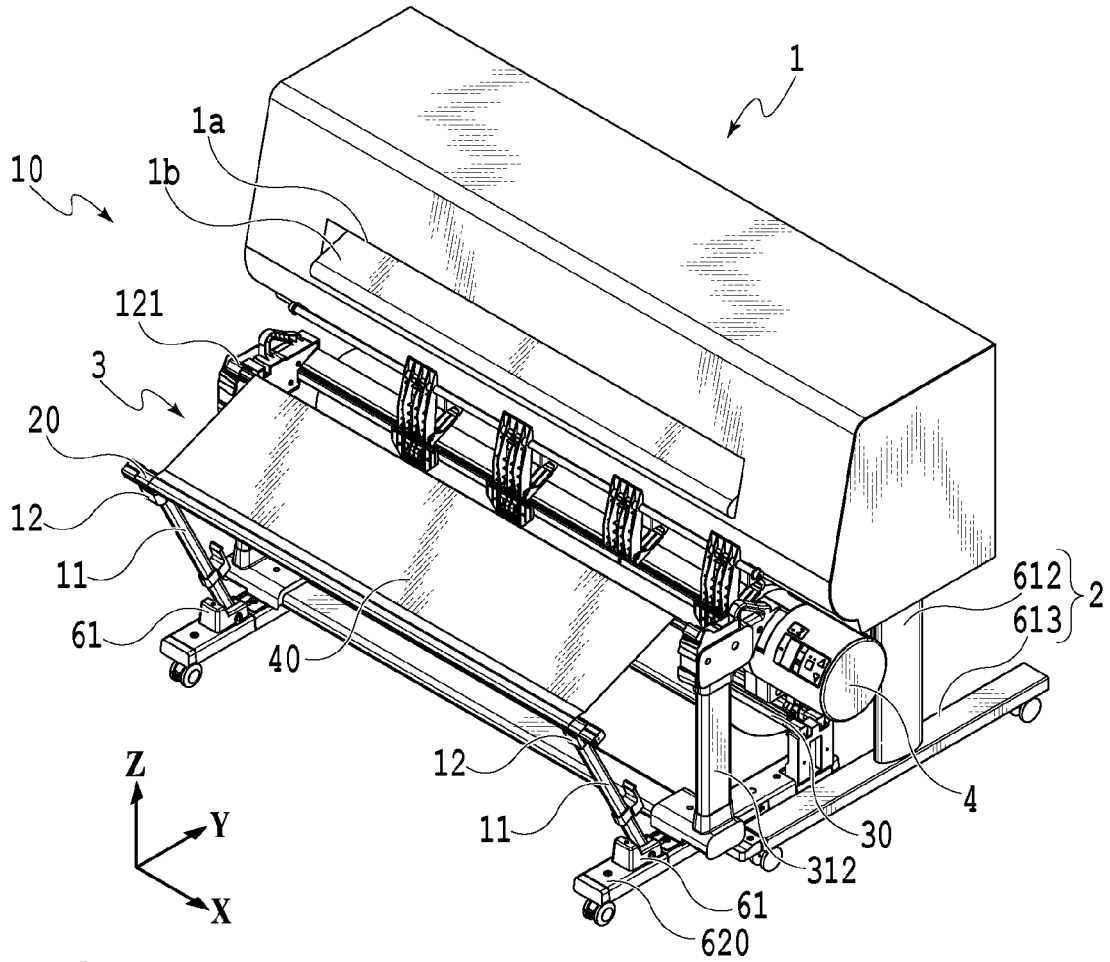
FIGS. 1A and 1B are views each illustrating a printing apparatus according to one embodiment of the present invention.
Figure 1B:
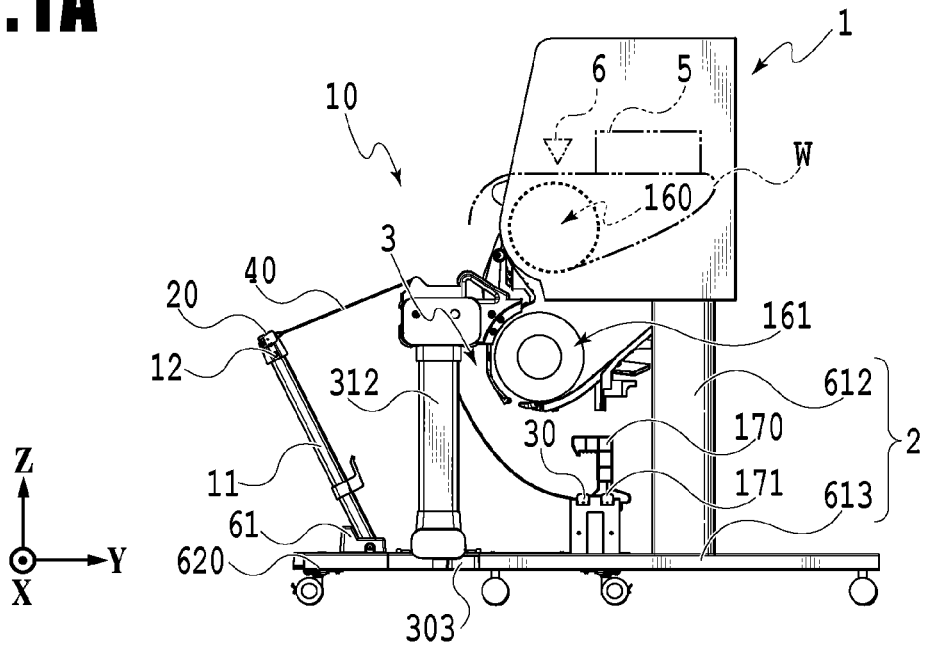

FIG. 1A is a perspective view of a printing apparatus 10 as a sheet processing apparatus according to an embodiment of the present invention, and FIG. 1B is a side view of the printing apparatus 10. The printing apparatus 10 includes the body of a printer (printer body) 1 and a stacker 3 (sheet housing apparatus) arranged separately from the body 1. The body 1 includes roll paper holding units (roll supporting units) 160, 161 which rotatably hold roll paper (roll sheet; print medium), and the roll paper is formed by winding an elongate continuous paper (continuous sheet) onto a paper tube. The roll paper held by the holding units 160, 161 is unwound as a sheet W, which is then fed to a printing unit 5 via a conveying mechanism (not shown) and the like. The holding unit 161 (second holding unit) is disposed below the holding unit 160 (first holding unit). In other words, the holding units 160, 161 are arranged so as to be aligned in a vertical direction. The holding unit 161 disposed below the holding unit 160 may be configured to include a function of winding the sheet W which has been fed from the holding unit 160 and has been printed thereon.

The printing unit 5 prints an image on the sheet W which has been conveyed from the holding units 160, 161 via the conveying mechanism. Between the printing unit 5 and a discharging opening 1*a* which discharges the sheet W printed by the printing unit 5, a cutter 6 is provided. The cutter 6 cuts the printed sheet W at its specified position. The body 1 includes a discharging opening guide 1*b* for guiding the sheet W discharged from the discharging opening 1*a* to the stacker 3. Along with printing operation, the sheet W being gradually discharged from the discharging opening 1*a* passes on the guide 1*b* and then changes its forwarding direction into downward to be hung down due to its own weight. The holding units 160, 161 are disposed below the discharging opening 1*a* and the guide 1*b*. Further, considering, for example, replacement of roll paper by a user, the holding units 160, 161 are provided to be disposed at an approximate center of the printing apparatus 10 in its height direction.

The holding units 160, 161 are provided to be disposed at the front side (the left side in FIG. 1B) of the printing apparatus 10 at which the discharging opening 1*a* is open. Due to this arrangement, the user can set roll paper on the holding unit 160 provided inside the body 1, for example, after moving the stacker 3 away from the body 1 to open a casing of the body 1 from the front side of the printing apparatus 10. Further, the user can also set the roll paper on the holding unit 161 from the front side of the printing apparatus 10. Accordingly, the user can replace roll paper from the front side of the printing apparatus 10 without moving the printing apparatus, thereby alleviating a burden on the user in replacing roll paper.

The user can operate various switches provided on an operation unit 4 of the body 1 to input various commands such as designating the size of a sheet and switching between online/offline. The present invention is not limited to the printing apparatus of a two-step configuration including two roll paper holding units as in the present embodiment, but may also be applied to a printing apparatus having one roll paper holding unit or three or more roll paper holding units. Further, in a case of including three or more roll paper holding units, at least two of them include the roll paper holding units 160, 161.

The stacker (sheet housing apparatus) 3 houses a sheet cut by the cutter 6 after having been printed and is movable relative to the separate body 1, and is arranged at a use position (housing position) for housing a sheet discharged from the discharging opening 1*a* of the body 1. The stacker 3 includes a receptor 40 of a sheet shape which is made of member (such as a cloth or plastic) that is thin, flat, and flexible. One end of the receptor 40 is held by a front rod 20, and the other end thereof is held by a rear rod 30. Therefore, the front rod 20 and the rear rod 30 function as holding members which hold the respective ends of the receptor 40. To be more specific, the front rod 20 holds one end of the receptor 40 on the downstream side in a discharging direction of a sheet to be discharged from the discharging opening 1*a* (the leftward side in FIG. 1B apart from the body 1). The rear rod 30 holds the other end of the receptor 40 on the upstream side in the discharging direction of a sheet (the right side in FIG. 1B near the body 1). Both ends of the front rod 20 are connected to two side rods 11, respectively, via connecting members 12. The side rods 11 are held by side rod holding members 61, and these holding members 61 are attached to the stacker 3 side as will be described later.

Figure 2A:
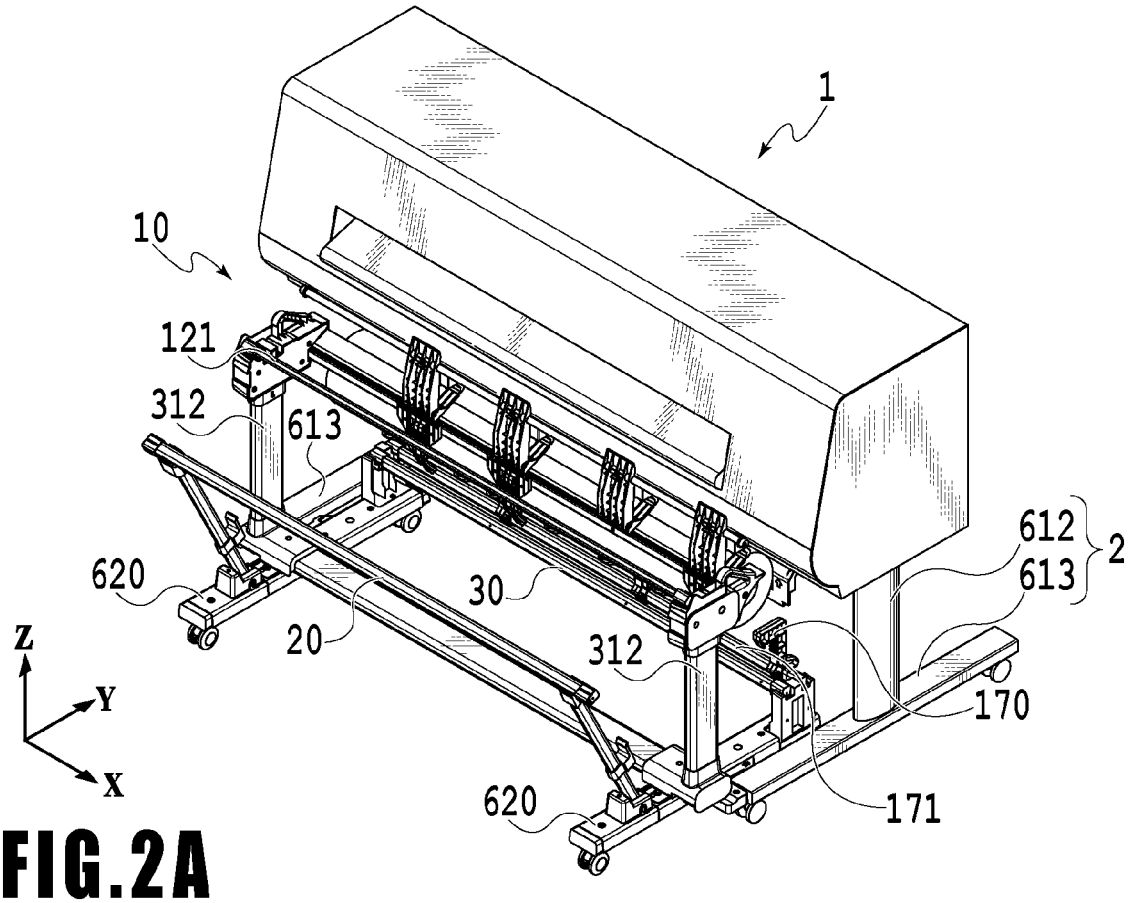
FIGS. 2A and 2B are views each illustrating the printing apparatus of FIGS. 1A and 1B in which the illustration of a receptor is omitted.
Figure 2B:
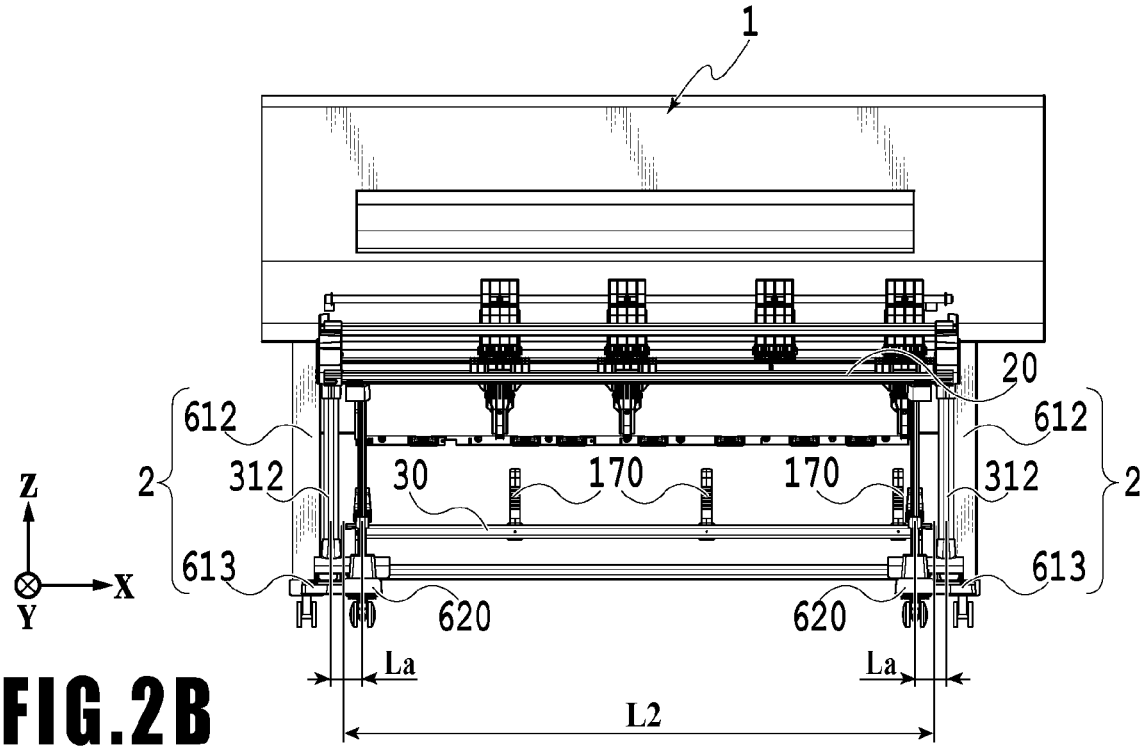

FIG. 2A is a perspective view of the printing apparatus 10 in which the illustration of the receptor 40 is omitted, and FIG. 2B is a front view of the printing apparatus. On the part of the receptor 40 disposed in the middle between the front rod 20 and the rear rod 30, a non-illustrated hole bag is formed along a width direction of a sheet. An upper rod 121 passes through the hole bag so as to hold the mid part of the receptor 40. The upper rod 121 supports the receptor 40, as will be described later, by positioning it on the stacker 3 side. The upper rod 121 is movable, and functions as a supporting member that supports the mid part of the receptor 40.

Figure 3A:
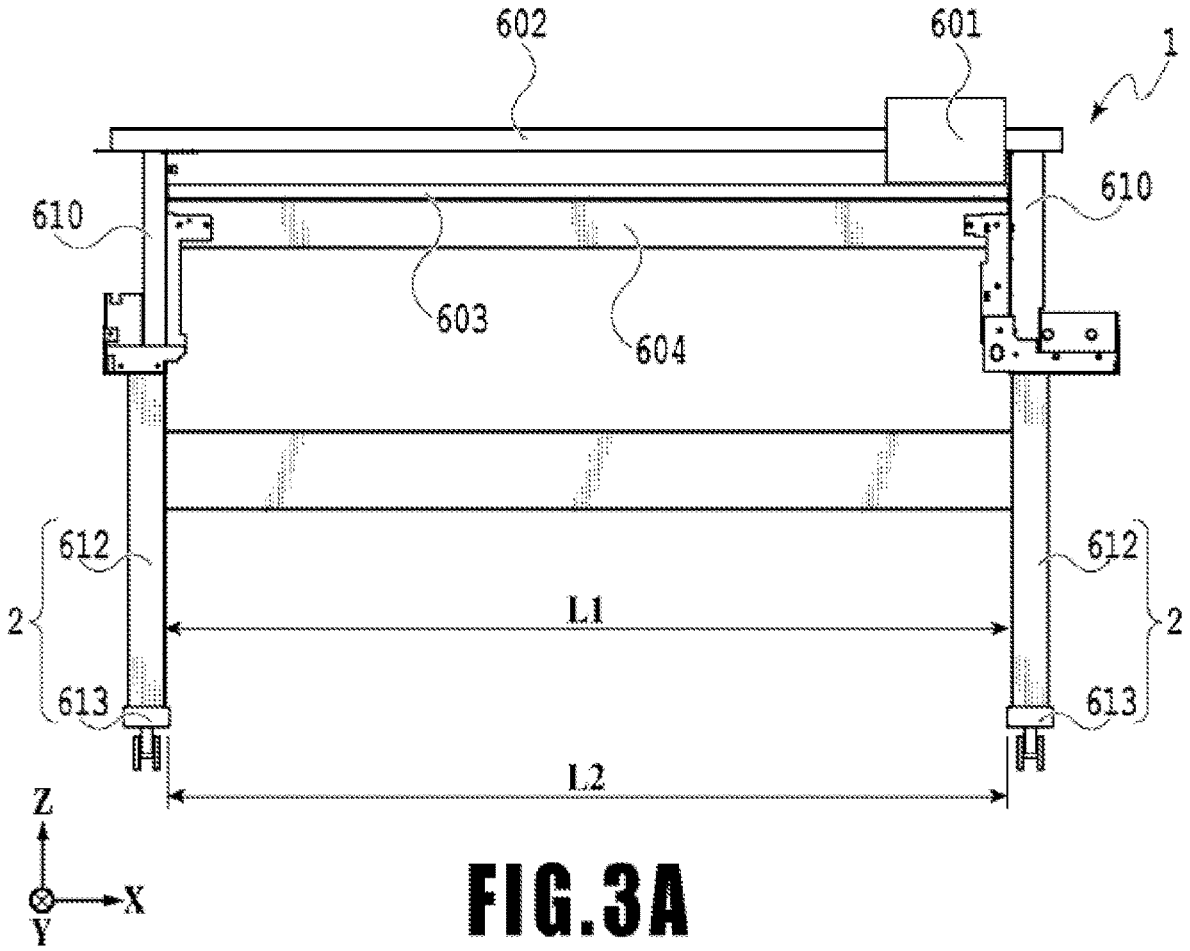
FIG. 3A is a view illustrating the body of the printing apparatus and FIG. 3B is a view illustrating a stacker as a sheet processing apparatus.
Figure 3B:
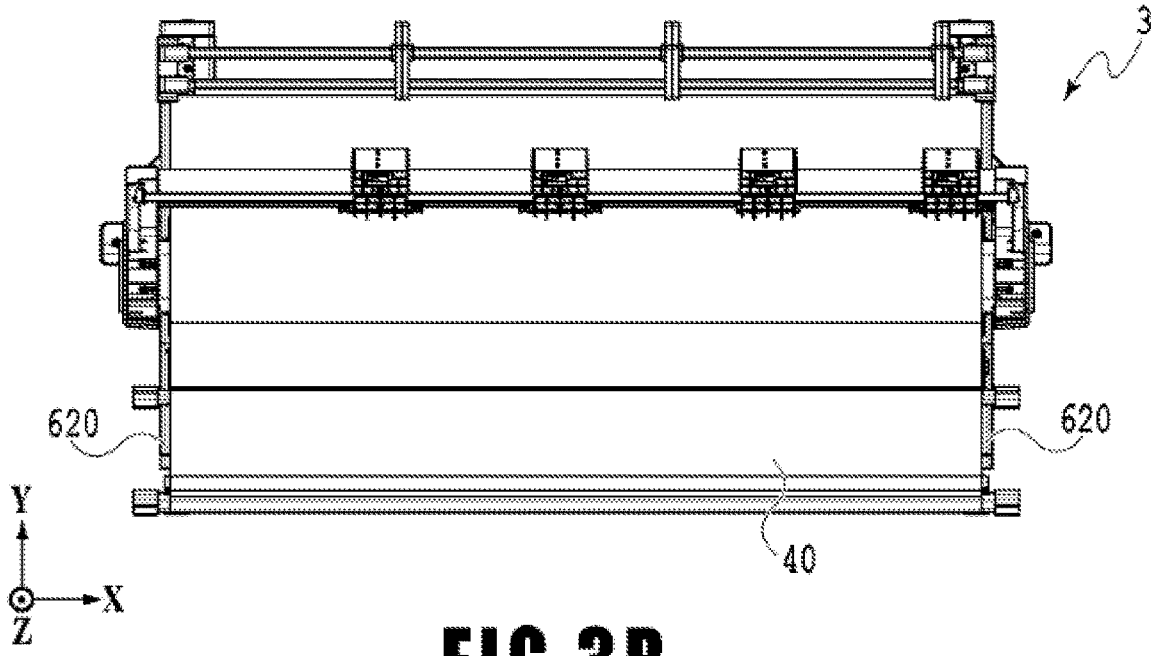

FIG. 3A is a front view of the body 1 for illustrating the frame structure of the body 1, and FIG. 3B is a plane view of the stacker 3 for illustrating the frame structure of the stacker 3.

In the frame structure of a typical printer, both ends of outer sides of major structure bodies in the sheet width direction are supported by the total of two columns which correspond to those structure bodies. Particularly, a large-sized printer which handles large-width sheets often handles the size of more than 1 m in the sheet width direction, and thus the printer has a large weight. Accordingly, in the frame structure that supports both ends of outer sides of the major structure bodies for the printer from the bottom, a warp may possibly occur on the printing unit including a print head and a platen which are major units of the printer and on a sheet conveying unit, thereby affecting printing accuracy.

In the present embodiment, as in FIG. 3A, side support bodies 610 which are essential parts in positioning the major units of the frame structure bodies within the body 1, that is, the side support bodies 610 which support both sides of the printing unit and the sheet conveying unit are supported from directly below by body legs (columns on the body side) 612. Due to this structure, it is possible to suppress deformation of the side support bodies 610 and to suppress a warp on the printing unit and the sheet conveying unit. The printing unit includes a carriage 601 to which the non-illustrated print head is mounted and which moves reciprocally in the sheet width direction and a carriage stay 602 which supports the carriage 601. In addition, the sheet conveying unit includes a non-illustrated conveying roller, a platen 603 disposed on the lower side of the carriage 601, and a platen stay 604 which supports the conveying roller and the platen. The printing unit and the conveying unit in this example may be collectively referred to as a printing unit.

As such, in supporting directly below the side support bodies 610 which support both sides of the printing unit and sheet conveying unit with the body legs 612, the body legs 612 are to be disposed at the inner sides of the sheet width direction compared to a case of supporting both ends of the outer sides of the major structure bodies. Therefore, a distance L1 between the two body legs 612 and a distance L2 between two body feet (feet on the body side) 613 supporting these legs become short. On the body feet 613 of the body, casters are provided as shown in FIG. 1A and the like. In addition, due to the demand expansion of such large-sized printers due to SOHO, for example, reduction of an installation area for the body 1 is desired. Under such circumstances, the side support bodies 610 are required to be arranged more inwardly so as to reduce the width of the body 1. For this reason, the interval L1 between the two body legs 612 is required to be narrowed.

The stacker 3 of this example is configured to be separated from the body 1, and is used by locating it at a position (usage position) to receive a sheet to be discharged from the discharging opening 1*a* of the body 1. Accordingly, as shown in FIG. 2A and FIG. 2B, the body feet 613 and feet (stacker feet) 620 of the stacker 3 are set in a positional relation such that the feet (feet on the housing side) 620 of the stacker 3 are accommodated inside the body feet 613 so as not to physically interfere with each other. To be more specific, the feet 620 are disposed nearer to the center of a sheet than the body feet 613. In this example, the right and left feet 620 are disposed in the inner side of the corresponding right and left body feet 613, respectively. However, at least one of the pair of right and left feet 620 may be disposed in the inner side of a corresponding body foot 613. By disposing the foot 620 in the inner side of the corresponding body foot 613, an open space is likely to be formed at an outer side of the body foot 613. The open space can be used, for example, as a task space for an operator for operating the operation unit 4 in the body 1. It is desirable that such an open space be formed on at least one side of the lateral side (both sides in the sheet width direction) of the printing apparatus 10 for making the most of the space.

Furthermore, in a typical stacker, a leg is arranged on the center of a foot in its width direction so as to dispose the leg directly above the foot. In the stacker 3 of this example, as shown in FIG. 2A and FIG. 2B, legs (columns on the housing side; stacker legs) 312 are not directly disposed above the feet 620, and are arranged so as to be standing outside of the feet 620 in their width directions. In other words, the central axes of the legs 312 in the sheet width direction is deviated to the outside by a distance La from the central axes of the feet 620 in the sheet width direction so that the legs 312 are not directly disposed above the feet 620. To be more specific, the former central axes are disposed apart from the center of the sheet in its width direction compared to the latter central axes, and an interval between the right and left legs 312 is larger than an interval between the right and left feet 620. In other words, side faces of the legs 312 disposed closer to the center of a sheet are disposed apart from the center of the sheet compared to side faces of the feet 620 disposed closer to the center of the sheet. In this example, the right and left legs 312 are disposed outside the corresponding right and left feet 620, respectively. However, at least one of the pair of right and left legs 312 may be disposed outside the corresponding foot 620.

Due to such a configuration, as shown in FIG. 3B, the receptor 40 can be arranged over a wide range including the upper position of the feet 620, and the width of the receptor 40 can be increased for that range to securely receive a large-sized sheet. In addition, a cut sheet may be dropped onto the receptor 40 in a slanting manner. To cope with this, it is desirable that the width of the receptor 40 be extended to the outside of the ends of the sheet. However, since the role of the receptor 40 is to receive the sheet without dropping it onto a floor or the like, the receptor 40 may be arranged between the two feet 620 instead of expanding it to the range over the upper position of the feet 620. To be more specific, the role of the receptor 40 can be fulfilled even if the receptor 40 is arranged between the two feet 620 instead of, in viewing from the above, overlapping the receptor 40 with the feet 620. In this case, a space including the outer side of the receptor 40 and the inner side of the legs 312 is to be functioned as a sheet receiving unit. As such, the use of the space including the inner side of the legs 312 and the lower side of the body 1 as a sheet housing unit consequently allows reducing the dimension in the depth direction (the lateral direction in FIG. 1B) of the printing apparatus 10.

In order to house large sheets in various forms, a space directly under the body 1 should be desirably used for a sheet housing space. As a sheet housing form, for example, a face-down stacking which sequentially piles up discharged sheets with image-printed faces facing down can be achieved. The face-down stacking is favorable, compared to a face-up stacking which sequentially piles up discharged sheets with image-printed faces facing up, in that a printed face of a discharged sheet is unlikely to be caught by the front end of a subsequently discharged sheet. Accordingly, the face-down stacking has an advantage that a flaw is unlikely to occur on a printed surface. In addition, in the face-down stacking, a user does not need to rearrange sheets in order because printed sheets with their printed faces facing down are piled up in sequence.

In this example, the central axes of the foot 620 and leg 312 are deviated by a distance La so as not to dispose the leg 312 directly above the foot 620. However, the leg 312 may be disposed to be deviated outside of the center of the foot 620 in its width direction, and may not be projected to the outer side of the feet 620. To be more specific, a face of the inner side of the leg 312 may be disposed at the outer side in the sheet width direction compared to a face of the inner side of the foot 620, and at least a portion of the leg 312 may be directly disposed above the foot 620. As will be described later, the leg 312 is projected in the width direction so as to be deviated up to an upper position of a later-described contact member (positioning unit) 303, and the contact member 303 is not disposed in the front side of the leg 312 (leftward in FIG. 1B) in the longitudinal direction of the stacker 3. Due to such positional relation between the leg 312 and the contact member 303, an unintentional contact between the user and the contact member 303 can be avoided and breakage of the contact member 303 caused by unexpected pressure application can be prevented.

In the stacker 3, as shown in FIG. 2A and FIG. 2B, a plurality of first abutting members 170 which stops the front end of a sheet are arranged. The first abutting members 170 are provided on a stopper rod 171 which is provided parallel to the rear rod 30 so as to be aligned in the sheet width direction (a direction crossing (orthogonal to) a sheet discharging direction). The rear rod 30 and the stopper rod 171 are, as will be described later, attached to rod holding members 31 via rod caps 172 which are attached to both ends of the rear rod 30 and the stopper rod 171. The first abutting member 170 is, in the case where the body 1 and the stacker 3 are combined as shown in FIG. 1B, disposed at the back face side of the printing apparatus (the rightward side in FIG. 1B) rather than at the holding unit 161 of roll paper. Due to this arrangement, the stacker 3 has a sheet housing unit formed therein so as to include an area disposed on the lower side of the holding unit 161 in the gravity direction. As such, the printing apparatus 10 uses a space underneath the holding unit 161 of roll paper as a part of the sheet housing unit so that the length in a depth direction (the lateral direction in FIG. 1B) can be reduced while sufficiently ensuring the sheet housing space.

Figure 4:
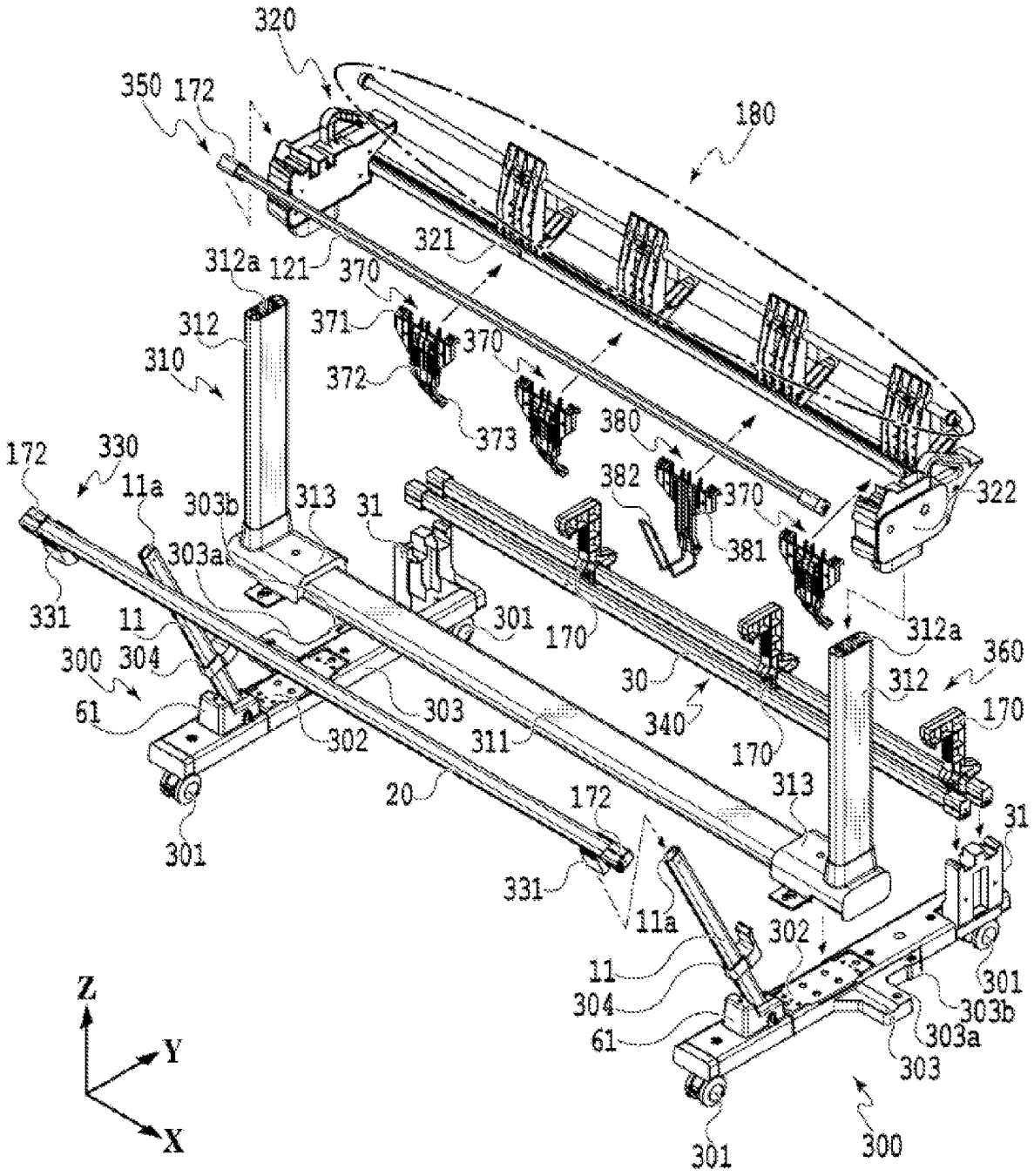
FIG. 4 is an exploded perspective view of the stacker.

FIG. 4 is an exploded perspective view of the stacker 3, and for the convenience of explanation, the illustration of the receptor 40 is omitted. The stacker 3 is set up by a user (user setup) as shown in a long and short dashed line in FIG. 4. Units which are to be set up by the user (including screw tightening) include a foot unit 300, a stay leg unit 310, a back stay unit 320, and a front rod unit 330. The front rod unit 330 is composed of three rods (front rod 20, rear rod 30, and upper rod 121) which hold the non-illustrated receptor 40. As a further target of the user setup, a rear rod unit 340, an upper rod unit 350, a first sheet stopper unit 360, a roll guide unit 370, and a second sheet stopper unit 380 are included. The first sheet stopper unit 360 provides the first abutting members 170. In addition, a plurality of roll guide units 370 (three in the case of this example) are provided, and these can be attached on positions deviated from each other in the sheet width direction.

The right and left foot units 300 have their foot frames 302, to which two respective casters 301 are attached, and thus are movable in X and Y directions shown in FIG. 4. Accordingly, the foot units 300 are combined with the body 1, as shown in FIG. 1A and FIG. 1B, so as to be installed at a fixed position for receiving a sheet to be discharged from the discharging opening 1*a* of the body 1. To the foot frames 302, the contact members 303 are attached. Faces 303*a* of the contact members 303 both facing +Y direction and each of faces 303*b* facing +X direction and −X direction abut against the body 1 as will be described later. In addition, onto the foot frames 302, the side rod holding members 61 which rotatably hold two side rods 11 and the rod holding members 31 which hold the rear rod unit 340 and the first sheet stopper unit 360 are attached. To each of the two side rods 11, a rod holder 304 for receiving the upper rod unit 350 is attached. On the holder 304, the upper rod unit 350 is to be held as required in the case of changing the reception form of the receptor 40 of the stacker 3 as will be described later.

The stay leg unit 310 includes a stay 311 which extends in an X direction and the two of right and left legs 312 which extend in a Z direction. Both ends of the stay 311 are connected to the right and left legs 312 via non-illustrated members, and a unit of a U-letter shape is configured as a whole. Further, connecting parts between the stay 311 and the legs 312 are covered by covers 313.

The back stay unit 320 includes a back stay 321 which extends in the X direction, a guide flapper unit 180 which is disposed on the back stay 321, and two upper rod bases 322 which are attached on both ends of the back stay 321.

The receptor 40 is held by three rod units 330, 340, and 350. The front rod unit 330 includes the front rod 20, rod caps 172 on both ends of the front rod, and two front rod supports 331. The rear rod unit 340 includes the rear rod 30 and the rod caps 172 on both ends of the rear rod. The upper rod unit 350 includes the upper rod 121 and the rod caps 172 on both ends of the upper rod.

The first sheet stopper unit 360 includes the plurality of first abutting members 170 (three in the case of this example) disposed to be deviated from each other in the sheet width direction (the X direction) and the rod caps 172.

The roll guide unit 370 includes a first roll guide 371, a second roll guide 372 which is rotatably attached to the roll guide 371, and a roller 373 rotatably attached to the lower end of the roll guide 372. A plurality of roll guide units 370 (three in the case of this example) can be disposed in the sheet width direction (the X direction).

The second sheet stopper unit 380 includes a second sheet abutting member 381 and a wire tray 382 which is attached to the lower end of the abutting member 381.

In the user setup, the user firstly fits the cover 313 of the stay leg unit 310 into an opening part exposing the foot frame 302 located on the right or left foot unit 300. Accordingly, the foot unit 300 receives on its face the weight of the stay leg unit 310 and thus is easy to stand on its own. Therefore, the user can assemble (including screw tightening) the stay leg unit 310 into the right and left foot units 300 alone.

Next, into non-illustrated opening parts in the right and left upper rod bases 322 of the back stay unit 320, ends 312*a* of the legs 312 are inserted, and are tightened with screws. Then, into the front rod supports 331 disposed near both ends of the front rod 20 that holds one end of the receptor 40, ends 11*a* of the right and left side rods 11 are inserted, and are tightened with screws. The rod caps 172 at both ends of the rear rod unit 340 are attached to the recesses of the right and left rod holding members 31, and both ends of the upper rod unit 350 are disposed in the recesses of the upper rod bases 322 to be described later. The position of the upper rod unit 350 is changed in accordance with the reception form of the receptor 40 as will be described later, and thus the upper rod unit 350 may be placed on the rod holders 304. The rod caps 172 at both ends of the first sheet stopper unit 360 are attached to the recesses of the right and left rod holding members 31. The roll guide units 370 are attached to the back stay 321 along with their partial elastic deformation. The roll guide units 370 are configured to be detached due to application of a predetermined external force, and thus, if an additional external force is applied thereto caused by, for example, unexpected operation by the user, the roll guide unit 370 is detached without any breakage. The second sheet stopper unit 380 is attached to the back stay 321 along with its partial elastic deformation. The second sheet stopper unit 380 is detachable, and thus, the user can attach the second sheet stopper unit 380 as required in the case of changing the reception form of the receptor 40 as will be described later. In order to prevent the units 370 and 380 from being incorrectly mounted, a non-illustrated axis part of the unit 370 to be inserted into a non-illustrated hole on the back stay 321 and a non-illustrated axis part of the unit 380 to be inserted into a non-illustrated hole on the back stay 321 are formed on different positions. To the second sheet abutting member 381 in the second sheet stopper unit 380, the wire tray 382 is attached.

At the time of using the stacker 3, the stacker 3 is moved to a position to bring it in contact with the body 1 for positioning it to a fixed position (sheet using position) with respect to the body 1.

Figure 5B:
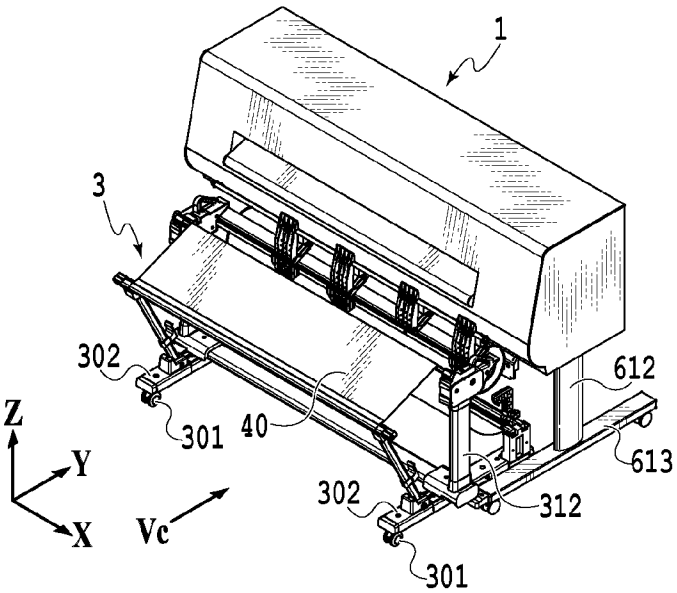
FIGS. 5A, 5B, and 5C are views each illustrating the positional relation between the body of the printing apparatus and the stacker.
Figure 5A:
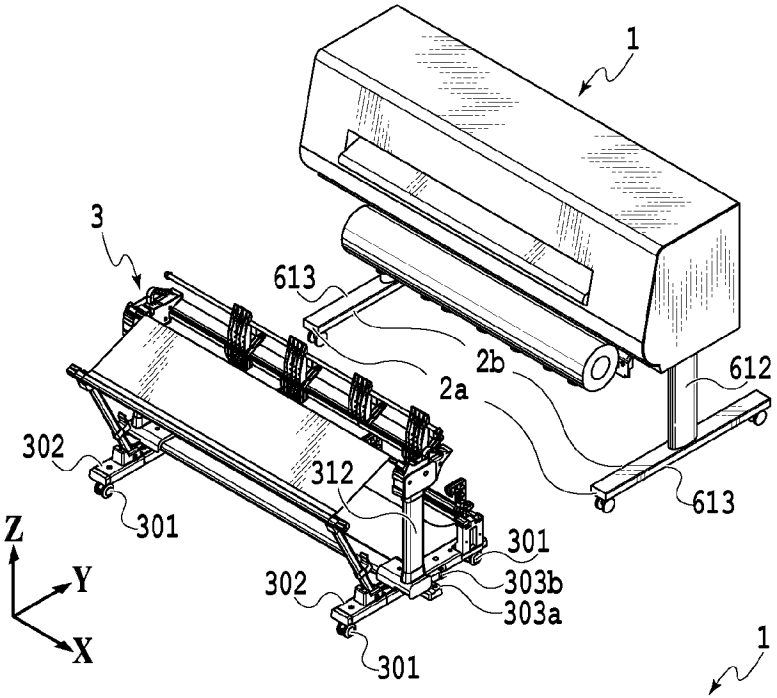
Figure 5C:
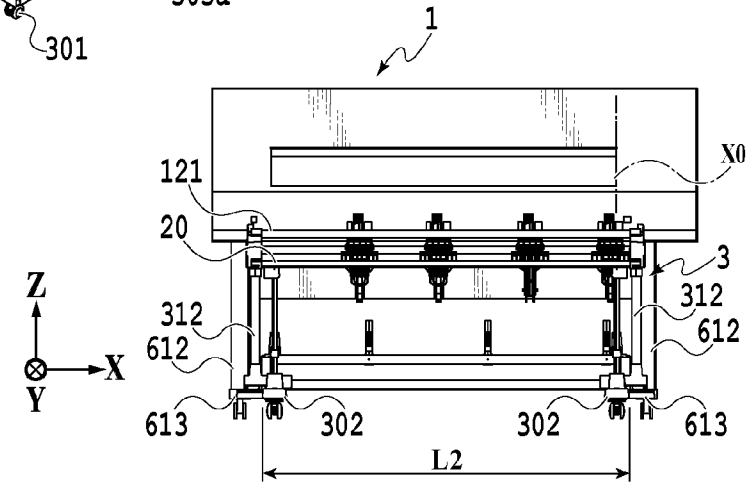

FIG. 5A is a perspective view in the state in which the stacker 3 is apart from the body 1, FIG. 5B is a perspective view in the state in which the stacker 3 is positioned at a fixed position which is in contact with the body 1, and FIG. 5C is a view seen from an arrow VC of FIG. 5B in the state without the receptor 40. The user moves the stacker 3 using the casters 301 in a predetermined direction of the arrow Y and causes the faces 303*a* of the contact members 303 facing +Y direction to abut faces 2*a* on the front side of leg parts 2 of the body 1 for engagement. A distance between the faces 303*b*, 303*b* of the contact members 303, 303 facing +X direction and −X direction is smaller than a distance L2 between inner side faces 2*b*, 2*b* of the leg parts 2, 2 of the body 1. Therefore, the stacker 3 is movable by a predetermined amount along the X direction in between the leg parts 2, 2 of the body 1. Considering such a moving amount in the X direction, the leg 312 on a reference position X0 side (the right side in FIG. 5C) of the end of a sheet to be discharged from the discharging opening 1*a* is disposed to be deviated on the outer side (the X direction) of the foot frame 302 so as not to be positioned on the inner side (−X direction) of the reference position X0. Therefore, even in the case where the stacker 3 moves in −X direction in the state of FIG. 5B, the leg 312 on the right side in FIG. 5B does not enter the inner side (−X direction) of the reference position X0. In this example, a non-reference side (the left side in FIG. 5C) of the leg 312 is disposed on the outer side (−X direction) of the corresponding foot frame 302. However, the non-reference side of the leg 312 is not limited to such a configuration, and may be disposed on the outer side in the sheet width direction to be used in the printing apparatus 10.

As such, by disposing the leg 312 on the outer side in the sheet width direction, a space in lower side of the printing apparatus 10 can be effectively used as a sheet housing space. Therefore, reduction of the depth (the lateral direction in FIG. 1B) of the printing apparatus 10 still allows housing large-sized sheets. In addition, by using the lower part of the stacker 3, which is separate from the body 1 of the printing apparatus 10, as a sheet housing part, the above-described face-down stacking can be realized.

Figure 6:
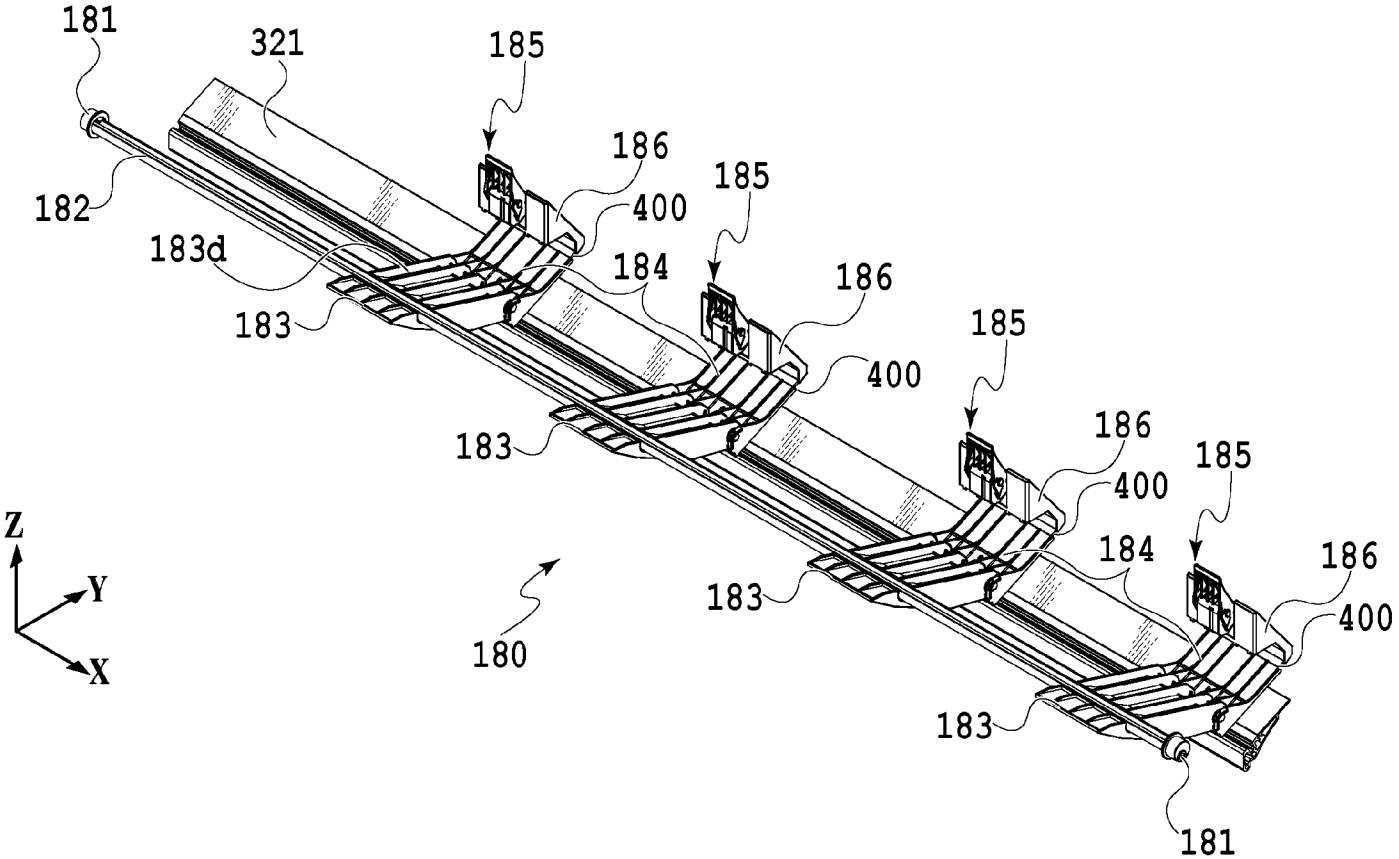
FIG. 6 is a perspective view of a guide flapper unit in the stacker.

FIG. 6 is a perspective view of major parts of the guide flapper unit 180. The guide flapper unit 180 includes a plurality (four in the case of this example) of flappers (movable guides) 183, a plurality of guides 184 to which these flappers 183 are rotatably attached, and a guide rod 182 which holds the plurality of flappers 183. To both ends of the guide rod 182, cap members 181 are attached so as not to be directly touched by the user. The guides 184 are attached on the guide plates 400, and these guide plates 400 have sheet guide holders 186 attached thereto which rotatably hold sheet guides 185 (movable guides). The sheet guide 185 is biased in a direction of the body 1 side (an arrow A direction in FIG. 7B) by a non-illustrated torsion coil spring. The guides 184 and the sheet guide holders 186 are attached on the back stay 321 via the guide plates 400.

The relation between the sheet guides 185 and the contact members 303 will be described. The contact members 303 are, as described above, to make positioning between the body 1 and the stacker 3. However, a path for a sheet between the body 1 and the stacker 3 must be connected at the upper part, which is apart from the positioning location fixed by the contact members 303, and large component tolerance is likely to occur on the connecting part of the path (contact part between the sheet guides 185 and the body 1). Since the contact part on the body 1 side is a resin component extending in the sheet width direction, the contact part on the body 1 side may be damaged if positioning of the body 1 and the stacker 3 is made at a position of this contact part. For this reason, as described above, the contact members 303 are used to make positioning of the body 1 and the stacker 3 at the robust leg part 2 of the body 1. Even if the user presses the stacker 3 against the body 1 with a strong force, such load is received by the robust leg part 2 of the body 1, and thus no damage is to be caused. In this example, in order to absorb component tolerance at the connecting part of the path, the torsion coil spring is used to bias the sheet guides 185 on the body 1 side.

Figure 7A:
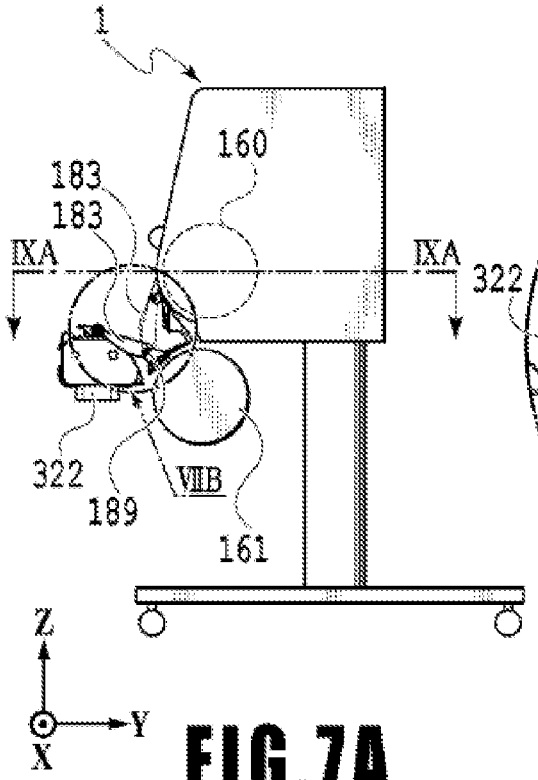
FIG. 7A is a view illustrating the guide flapper unit.
Figure 7B:
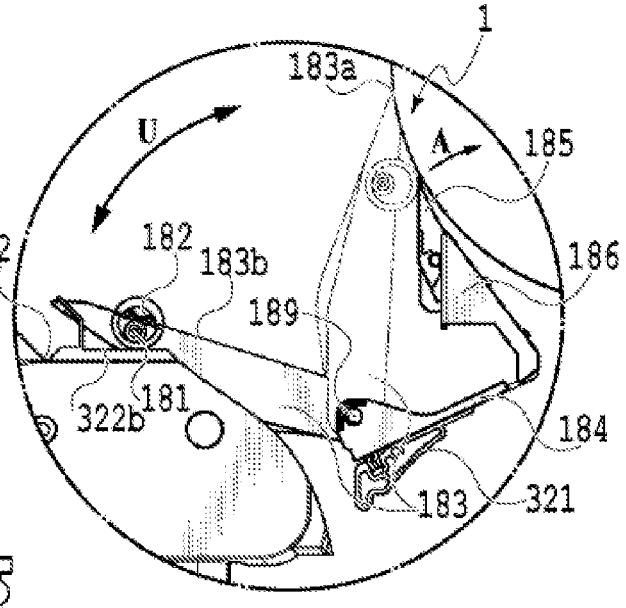
FIG. 7B is an enlarged view taken from circle VIIB of FIG. 7A.

FIG. 7A is a side view of the printing apparatus for illustrating the positional relation between the flappers 183 and sheet guides 185 which are disposed above the sheet housing part and the body 1, and illustration of unnecessary parts for explanation is omitted. FIG. 7B is an enlarged view taken from circle VIIB of FIG. 7A.

The flapper 183 is operated to be open and closed, and in an open state, a sheet to be discharged from the discharging opening 1*a* of the body 1 is supported, whereas in a closed state, the sheet is guided downward. To be more specific, the state in which the flapper 183 is open refers to a state in a rotational position shown with a solid line in FIG. 7B which opens a lateral-facing recess formed by the guide 184 and the sheet guide holder 186 and which can support the end portion of a sheet to be discharged from the discharging opening 1*a*. On the other hand, the state in which the flapper 183 is closed refers to a rotational position shown with a long and short dashed line in FIG. 7B, which covers the lateral-facing recess formed by the guide 184 and the sheet guide holder 186 and which guides a sheet downward without supporting the end portion of a sheet to be discharged from the discharging opening 1*a*.

The plurality of guides 184 to which the plurality of respective flappers 183 are rotatably attached are arranged to be aligned in the sheet width direction, and each of the flappers 183 can be open or closed in an arrow U direction as shown in FIG. 7B. The flappers 183 and the guides 184 have, as will be described later, a function as a guide part to guide a sheet downward and a function as a reception part to support a sheet.

As in the solid line in FIG. 7B, in the state in which the flappers 183 are open (first and second reception forms to be described later), each end of the sheet guides 185 is in contact with the body 1. A reason for this is that each of the sheet guides 185 are biased in the arrow A direction by the non-illustrated torsion coil spring and each of the sheet guides 185 is independently in contact with the body 1. Accordingly, the sheet guides 185 function as a guide for delivering the front end of a sheet, which is to be discharged from the discharging opening 1*a*, from the body 1 side to the guide 184 side. On a part of the body 1 with which the tip ends of the sheet guides 185 are in contact, a discharge guide which guides a sheet is formed. On the other hand, as shown in the long and short dashed line in FIG. 7B, in the state in which the flapper 183 is closed, a tip end 183*a* of the flapper 183 is in contact with the body 1. The flapper 183 in this state functions as a guide for delivering the front end of a sheet, which is to be discharged from the discharging opening 1*a*, from the body 1 side to the guide 184 side.

Figure 7C:
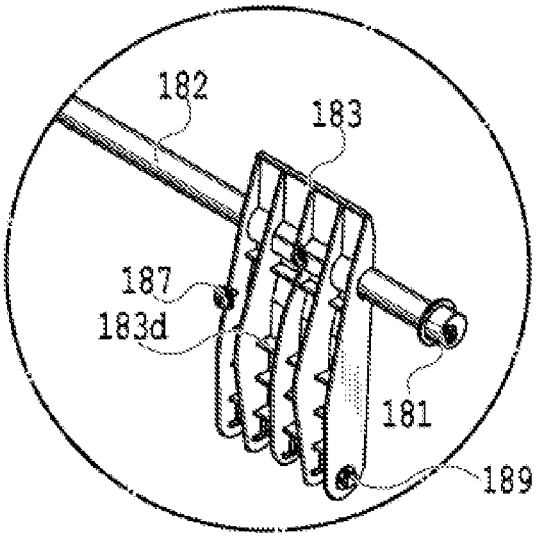
FIG. 7C is a view illustrating a flapper.
Figure 7D:
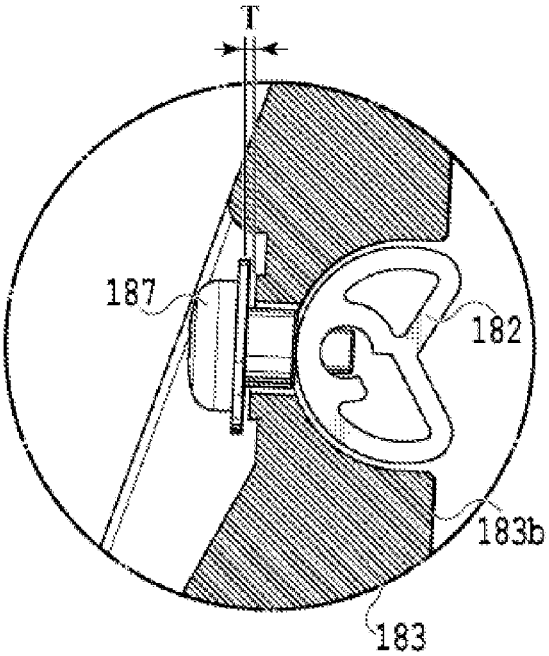
FIG. 7D is a view illustrating a guide rod.

For ensuring that each of the tip ends 183*a* of the flappers 183 is in contact with the body 1, the flappers 183 are attached to the guide rod 182 as shown in FIG. 7C and FIG. 7D. In other words, the flapper 183 is attached to the guide rod 182 by using a step-shaped screw 187 or the like by forming a clearance T between the flapper 183 and the guide rod 182 so as to include a backlash in the flapper 183. As such, by including the backlash in the flapper 183, in the state in which each of the flappers 183 is closed, those tip ends 183*a* are individually displaced so as to conform to the body 1. Consequently, each of the tip ends 183*a* of the flappers 183 is securely in contact with the body, and the front end of a sheet is prevented from entering between the tip ends 183*a* and the body 1. On the part of the body 1 with which the tip ends 183*a* of the flappers 183 are in contact, the discharge guide which guides a sheet is formed.

Figure 8A:
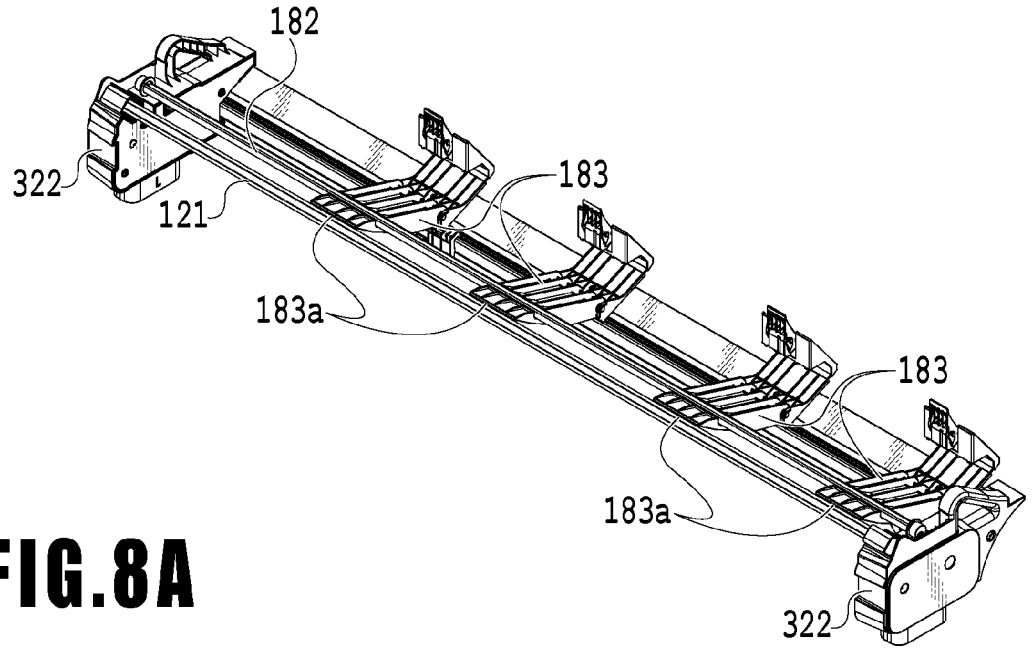
FIGS. 8A and 8B are views each illustrating the guide flapper unit in a case where a different housing form is selected.

FIG. 8A is a view illustrating the state of the flappers 183 in a third reception form to be described later, in which the open states of the flappers 183 are maintained by disposing the guide rod 182 on the right and left upper rod bases 322. In a case where multiple sheets are stacked on the flappers 183 in their open states, each of the flappers 183 has the backlash with respect to the guide rod 182, and thus the tip ends 183*a* of the flappers 183 are disposed above the upper rod 121 so as to conform thereto. Therefore, the weight of sheets applied on each of the tip ends 183*a* can be received by the upper rod 121. Consequently, loading resistance of the flappers 183 in the later-described third reception form can be ensured to prevent them from breakage.

Figure 8B:
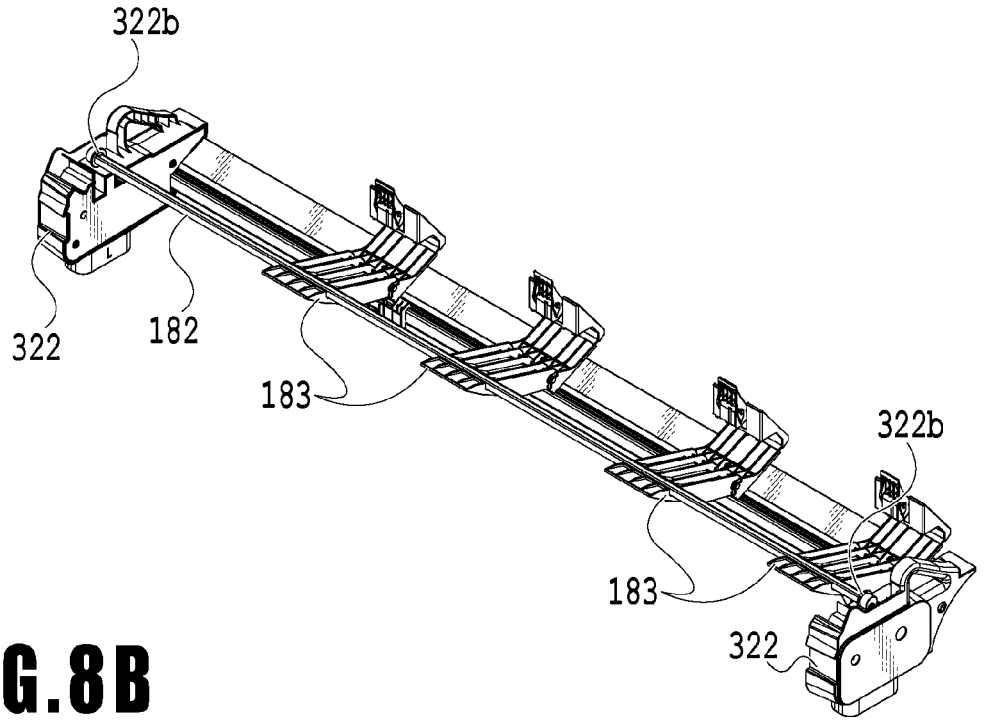

FIG. 8B is a view illustrating the state of flappers 183 in a fourth reception form to be described later, in which the open states of the flappers 183 are maintained by disposing the guide rod 182 on the right and left upper rod bases 322. In the fourth reception form, the upper rod 121 is removed from the position above the right and left upper rod bases 322. Since each of the flappers 183 has the backlash with respect to the guide rod 182, these flappers 183 do not restrict the movement of the guide rod 182. Therefore, both ends of the guide rod 182 are disposed above plane parts 322*b* of the upper rod bases 322 without being inclined. The flappers 183 are, by their own weight, in a state of being hung down from the guide rod 182 by an amount of the backlash with respect to the guide rod 182. Since the guide rod 182 is, as in FIG. 7D, protruded from plane parts 183*b* of the flappers 183, a sheet to be discharged from the discharging opening 1*a* can be securely received by the uniformly continuous guide rod 182 in the sheet width direction. Consequently, a sheet can be prevented from dropping from among each of the flappers 183. In addition, as in FIG. 6 and FIG. 7C, by forming protrusion shapes (ribs) 183*d* on both faces of the flappers 183, frictional resistance between the flappers 183 and a sheet can be reduced, and further, the weight of the flappers 183 can be suppressed. As a result of reducing the weight of the flappers 183, the user can cause the flappers 183 to rotate with smaller operating force.

A rotational center 189 of the flapper 183 is provided on the lower side of the flappers 183 in the gravity direction. Further, the rotational center 189 is disposed to be at the lower area of a rotating center of roll paper held by the roll paper holding unit 160 located at an upper side and is disposed to be at the higher area of a rotating center of roll paper held by the roll paper holding unit 161 located at a lower side. Therefore, in the printing apparatus 10, the discharging opening 1*a*, the rotating center of roll paper in the roll paper holding unit 160, the rotational center 189 of the flapper 183, and the rotating center of roll paper in the roll paper holding unit 161 are disposed in order in the gravity direction. In addition, as shown with the long and short dashed line in FIG. 7B, in the state in which the flappers 183 are closed, the tip ends 183*a* of the flappers 183 are disposed on a side near the body 1 (the right side in FIG. 7B) compared to the rotational center 189. Accordingly, the tip ends 183*a* of the flappers 183 are, by the weight of the flappers 183 and guide rod 182, in contact with the body 1 so as to lean on the body 1. Consequently, the tip ends 183*a* of the flappers 183 can be brought into contact with the body 1 without requiring any component such as a spring for applying a biasing force.

Figure 9A:
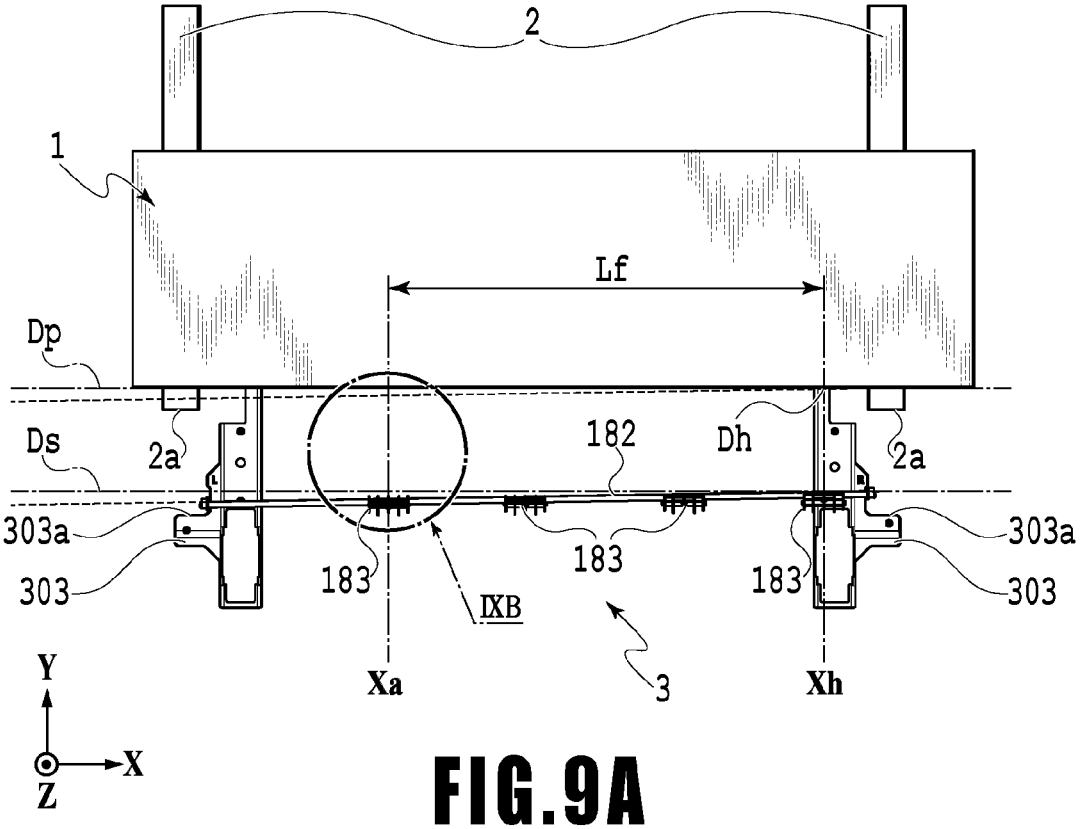
FIG. 9A is a view illustrating the positional relation between the body of the printing apparatus and the guide flapper unit.
Figure 9B:
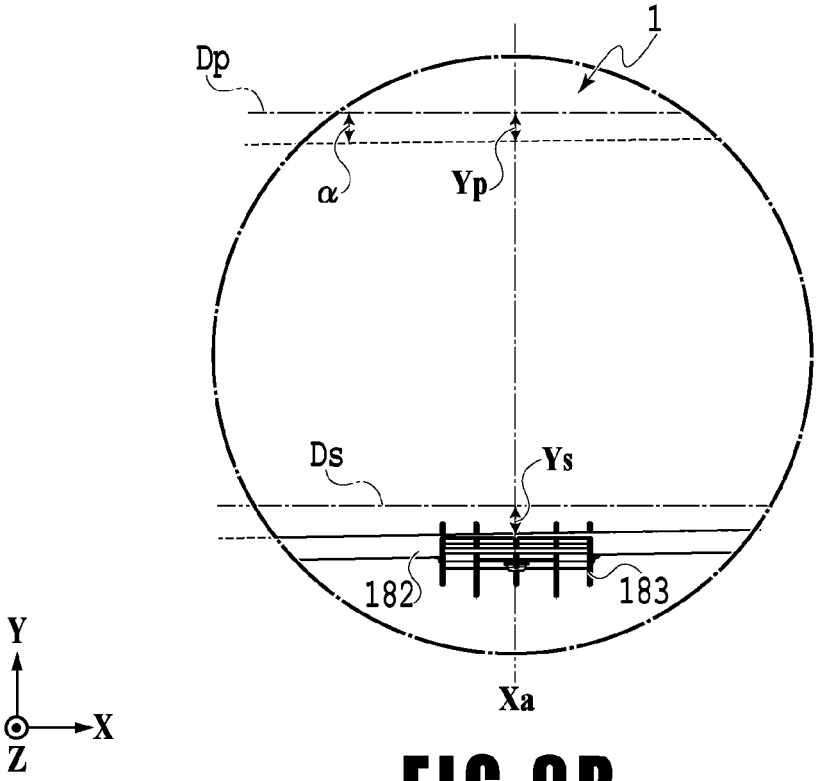
FIG. 9B is an enlarged view taken from circle IXB of FIG. 9A.

FIG. 9A and FIG. 9B are views illustrating movement of the flappers 183 at the time of bringing the stacker 3 closer to the body 1. FIG. 9A is a cross sectional view taken along IXA-IXA line of FIG. 7A, in which illustration of unnecessary parts for explanation is omitted. FIG. 9B is an enlarged view taken from circle IXB of FIG. 9A.

In FIG. 9A, a central position of the flapper 183 on a sheet reference position side in the sheet width direction is assumed as Xh and a central position of the flapper 183 on a non-reference side in the width direction of the sheet is assumed as Xa, and a distance between these positions Xh and Xa is assumed as Lf. In the case of bringing the stacker 3 to contact a printer 1 from the Y direction, the following situation is presumed. First of all, in the state in which the face 303*a* of the contact member 303 abuts the face 2*a* of the front side of the leg part 2 of the body 1, a design position where the tip end 183*a* of the flapper contacts the body 1 is assumed as Dp. A crossing of the position Dp and the central position Xh of the flapper 183 on the reference position side is assumed to be Dh. Then, regarding this crossing Dh as a center, a case in which the position of the body 1 contacting the tip end 183*a* of the flapper 183 is tilted by an angle $\alpha$ is assumed due to an influence such as tolerance or deformation. In this case, displacement amount Yp for the central position Xa of the flapper 183 on the non-reference position side in −Y direction becomes $Lf \times \tan \alpha$. As described above, since the flappers 183 each have the backlash against the guide rod 182, independent rotation can be made within a range of a certain extent. Accordingly, the flapper 183 on the non-reference position side is displaceable with respect to the flapper 183 on the reference position side in −Y direction by Ys. This displacement amount Ys is set to be larger than the displacement amount Yp on the body 1 side. This displacement amount Ys is deviated from the design position of the tip end 183*a* of the flapper 183 in −Y direction. However, the same shall apply to the case of deviation in a positive direction. In this example, the displacement amount is set to have 15 mm in −Y direction and about 15 mm in +Y direction. Further, such a setting condition on the backlash of the flapper 183 with respect to the guide rod 182 can be similarly applied to the third reception form to be described later in which the flappers 183 are in an open state.

Figure 10A:
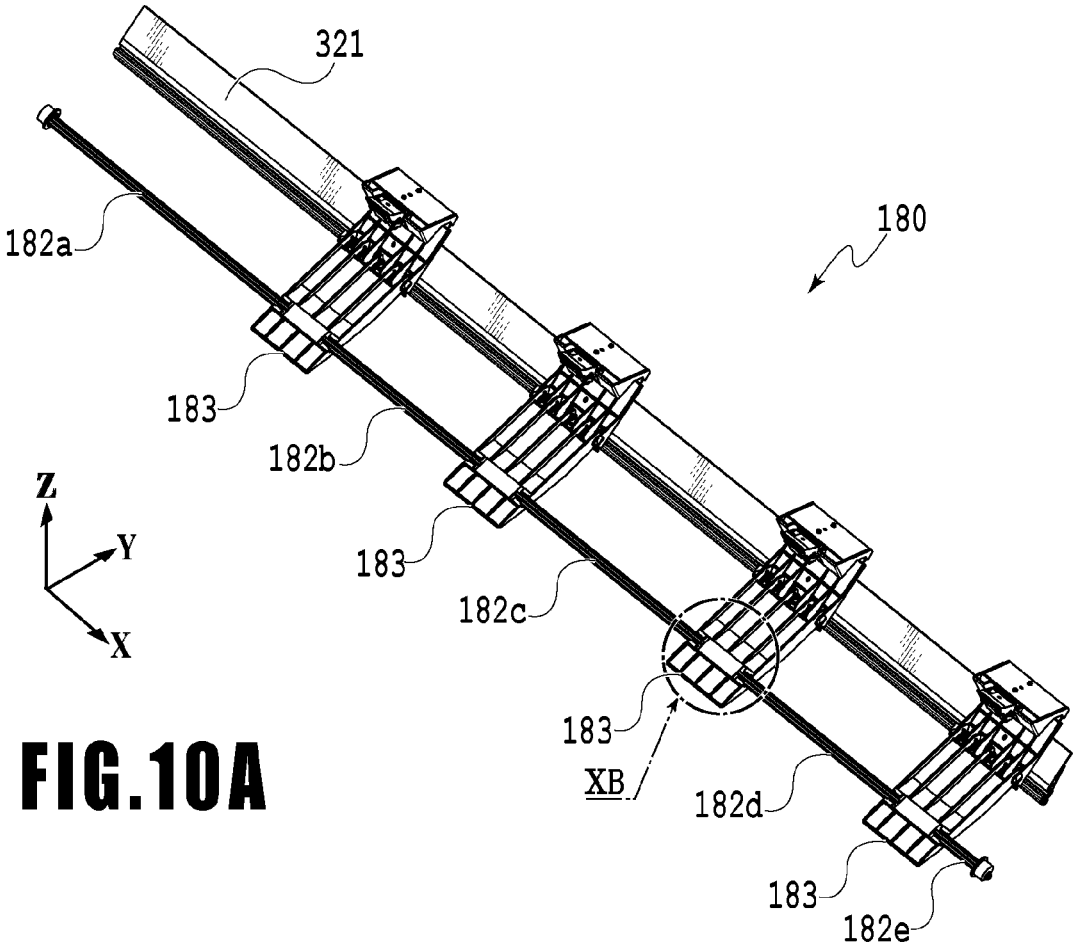
FIG. 10A is a view illustrating another configuration example of the guide flapper unit.
Figure 10B:
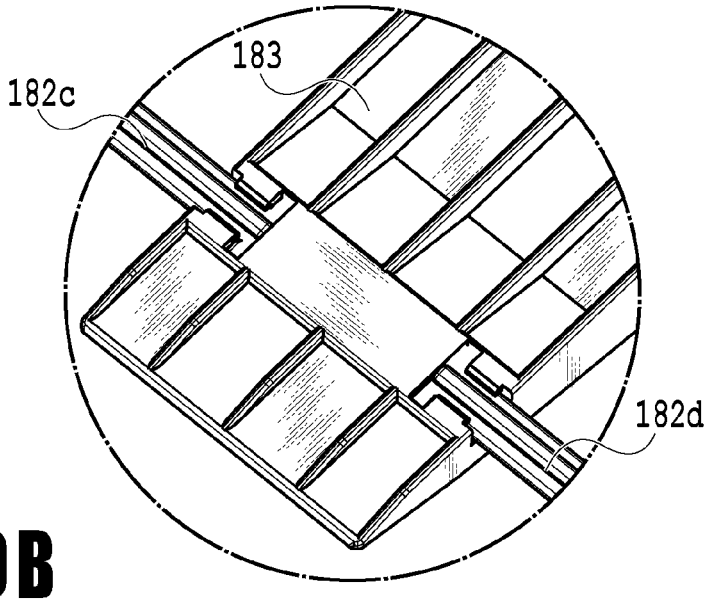
FIG. 10B is an enlarged view taken from circle XB of FIG. 10A.

FIG. 10A and FIG. 10B are views illustrating another configuration example of the flappers 183 and the guide rod 182 shown in FIG. 8A and FIG. 8B. Specifically, FIG. 10A is a perspective view of the guide flapper unit 180 and FIG. 10B is an enlarged view taken from circle XB of FIG. 10A. In this example, the guide rod is divided into a plurality of members 182*a*, 182*b*, 182*c*, 182*d*, and 182*e*, and the plurality of flappers 183 are connected via these members. In this configuration as well, the same effect can be obtained as the above-described configuration.

Figure 11:
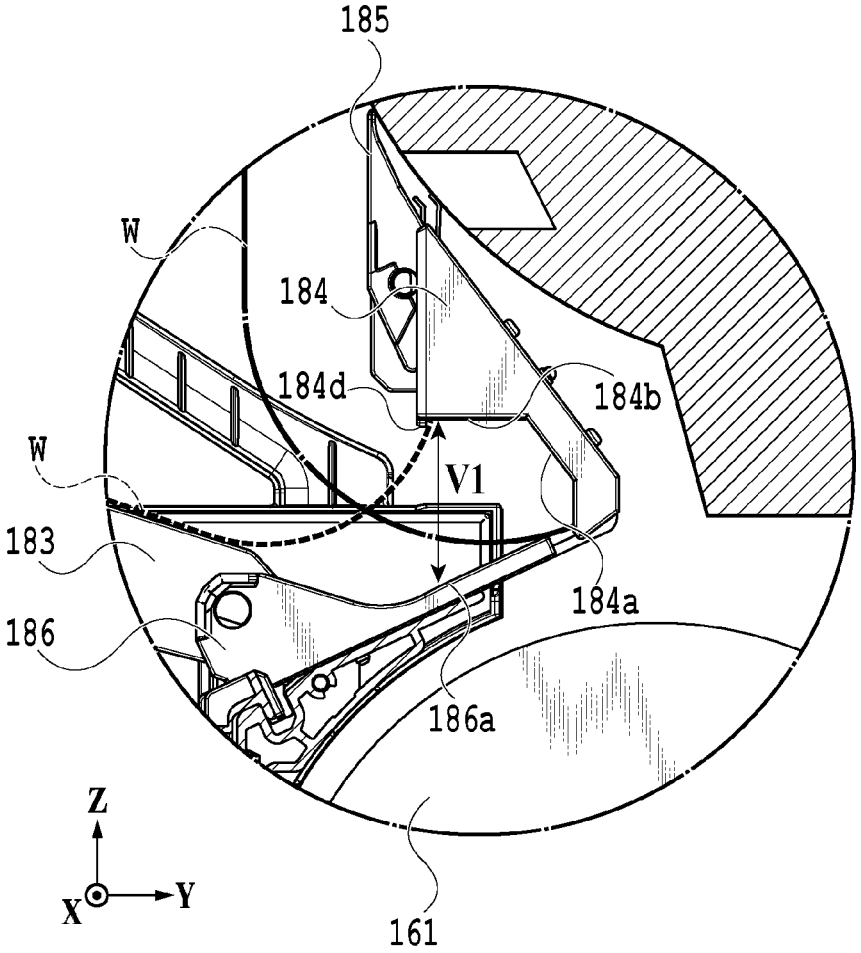
FIG. 11 is an enlarged view of major parts of the guide flapper unit.

FIG. 11 is an enlarged side view of major parts of the guide flapper unit 180, in which the flapper 183 is in an open state. In the guide 184, a lateral-facing recess (restriction part) extending in the sheet width direction is formed by a first restriction face 184*a*, a second restriction face 184*b*, and a third restriction face 186*a* of the sheet guide holder 186. Further, in the vicinity of an opening part in the upper face (second restriction face 184*b*) of the recess, a bump 184*d* (protrusion) is provided. The third restriction face 186*a* facing the second restriction face 184*b* is inclined toward the lower left side as shown in FIG. 11. Between the tip end of the bump 184*d* and the position of the third restriction face 186*a* in a vertical downward direction of the bump 184*d*, a predetermined clearance V1 is formed. The clearance V1 is formed so as to be larger than the total of a thickness at the time of stacking the maximum number of sheets and a maximum value of a curl amount of a sheet front end. The curl amount of the sheet front end corresponds to a distance from the bottom face of a sheet to the front end of the sheet having curled at maximum in a vertical upward direction in a state in which the sheet is hung in the vertical downward direction.

In this example, the maximum stacking number of sheets is set to be 100 under the conditions that the curl amount of the front end of the sheet is large and typically used plain paper wound on a paper tube having a diameter of 2 inch (50.8 mm) is adopted. The thickness of this plain paper is 0.1 mm per sheet, and thus becomes 10 mm (=100×0.1) in the case of stacking 100 sheets. In addition, a maximum value of a curl amount of the sheet front end (in the state in which the front end of a sheet portion of the paper at the beginning of winding near the paper tube is being hung in the vertical downward direction, a distance from the bottom face of the sheet to the front end of the sheet having curled in the vertical upward direction) is 10 mm. In this case, the clearance V1 shown in FIG. 11 is set to be equal to or larger than 20 mm (=100×0.1+10 mm). Also, a length of the second restriction face 184*b* in the depth direction (the lateral direction in FIG. 11) of the recess is set to be smaller than the radius of the paper tube (25.4 mm). A height of the bump 184*d* in its vertical direction (that is, a protrusion amount from the upper face of the recess) is set to be larger than the maximum thickness of a sheet that is expected to be used, which is, for example, set to be larger than the thickness of 0.1 mm for plain paper.

By changing the form of the upper rod unit 350 and the guide flapper unit 180 and by combining these forms, forms of using the flexible receptor 40 can be changed. In other words, the user can select the form of receiving the stacker 3 upon receiving a sheet to be discharged from the discharging opening 1*a* of the body 1 to adapt the form to diversifying printing modes. Reception forms of the stacker 3 will be described below.

(First Reception Form)

Figure 12A:
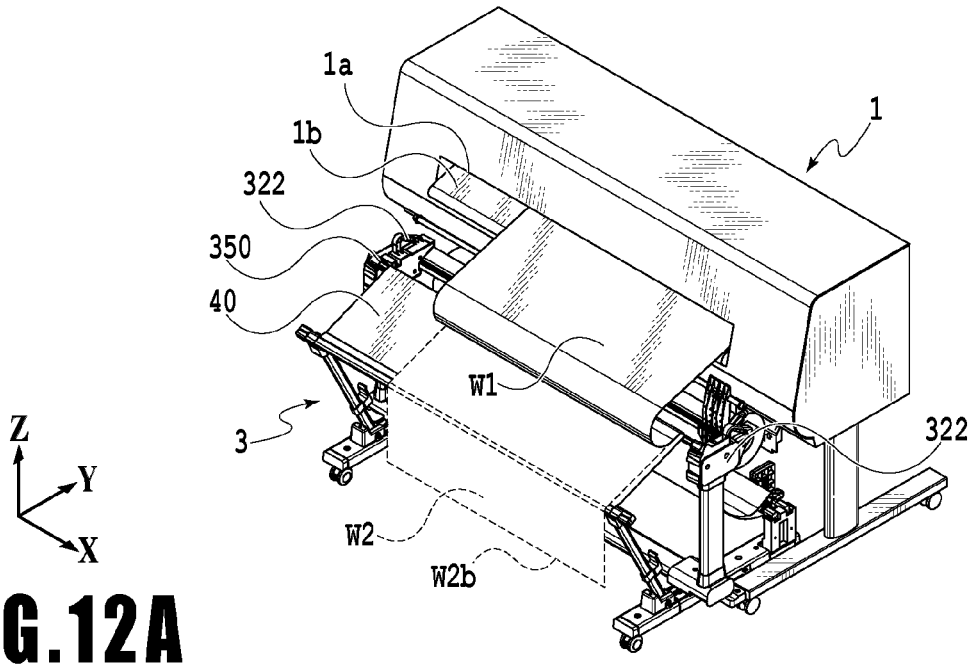
FIGS. 12A, 12B, and 12C are views each illustrating the state of the printing apparatus in the case of selecting a first reception form.
Figure 12B:
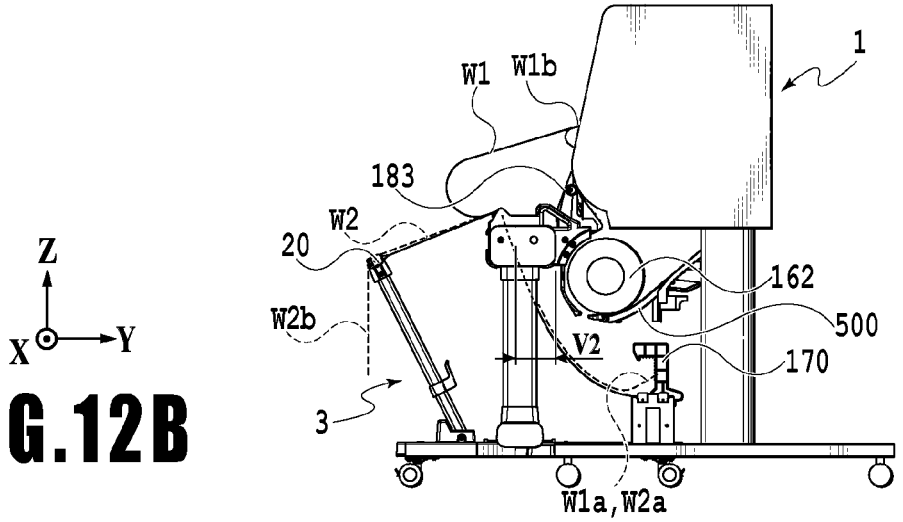
Figure 12C:
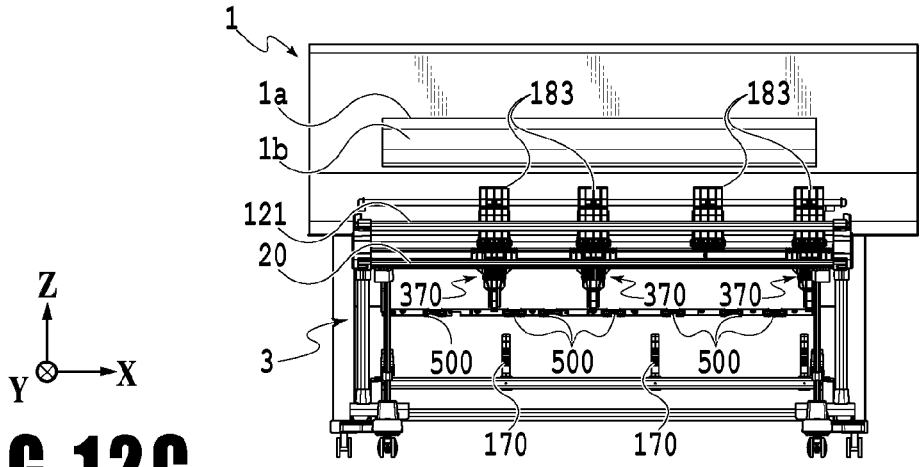

FIG. 12A, FIG. 12B, and FIG. 12C are views each illustrating the printing apparatus in a case where the first reception form is selected. Specifically, FIG. 12A is a perspective view of the printing apparatus, FIG. 12B is a side view of the printing apparatus, and FIG. 12C is a front view of the printing apparatus in which the illustration of the receptor 40 is omitted.

In the first reception form, the upper rod 121 of the upper rod unit 350 is positioned on the right and left upper rod bases 322. The flexible receptor 40 is, as shown in FIG. 12B, held in a V shape defined by the upper rod unit 350, the front rod unit 330, and the rear rod unit 340, and this shape forms a sheet housing part. Between the first roll guide 371 of the roll guide unit 370 attached to the back stay 321 and the receptor 40, a clearance V2 is formed. On the body 1, a plurality of feeding means 500 for separating a sheet from the roll paper 162 for feeding are arranged at positions deviated in the width direction of the roll paper 162. The roll guide units 370 are, as shown in FIG. 12C, attached on positions that do not interfere with the feeding means 500. The flappers 183 on the guide flapper unit 180 are rotated to be at positions for guiding a sheet to be discharged from the discharging opening 1*a* of the body 1 toward a lower part, that is, at positions for leading the front end of the sheet to the clearance V2 between the first roll guide 371 and the receptor 40.

A sheet W1 discharged from the discharging opening 1*a* of the body 1 is guided downward by the discharging opening guide 1*b*, the flappers 183, the first roll guide 371, and the second roll guide 372, and a front end W1*a* of the sheet W1 abuts the first sheet abutting members 170 and is stopped. Then, as the sheet W1 continues to be discharged, a middle portion of the sheet W1 forms a loop that curves toward a side apart from the body 1, as shown in FIG. 12B, with the position of the upper rod 121 of the upper rod unit 350 serving as an inflection point. Then, after a back end W1*b* of the sheet W1 is cut, the sheet W1 is flipped over to the left side in FIG. 12B with the position of the upper rod 121 serving as an inflection point. Then, the end W1*b* is hung downward from the front rod 20 of the front rod unit 330 similar to a back end W2*b* of a sheet W2 which has been previously discharged. The sheets W1 and W2 are, as shown in FIG. 12B, housed such that the respective portions between these front ends W1*a* and W2*a* and middle portions of the sheets are disposed within the receptor 40 and that the respective portions between these back ends W1*b* and W2*b* and the middle portions are supported on the receptor 40.

This first reception form is a form suitable for a relatively large sized sheet (for example, vertical A0), and is capable of adopting the face-down stacking with a printed sheet face facing down.

(Second Reception Form)

Figure 13A:
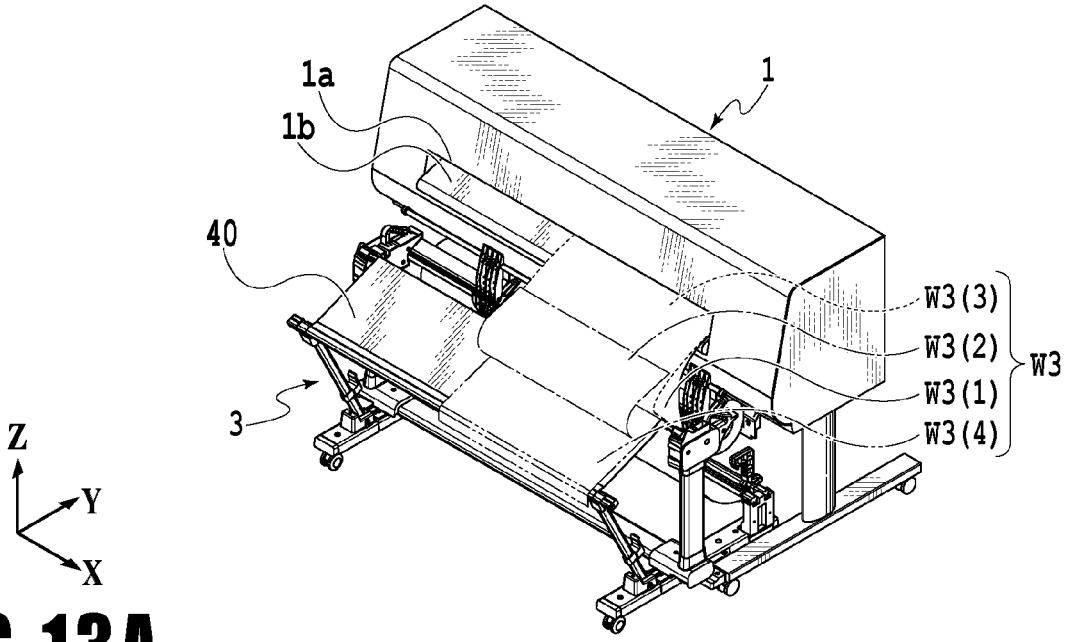
FIGS. 13A, 13B, and 13C are views each illustrating the state of the printing apparatus in the case of selecting a second reception form.
Figure 13B:
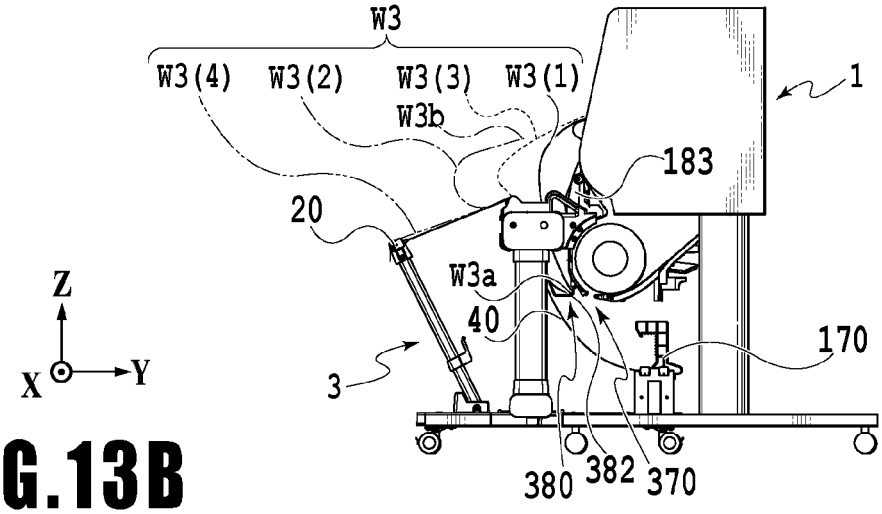
Figure 13C:
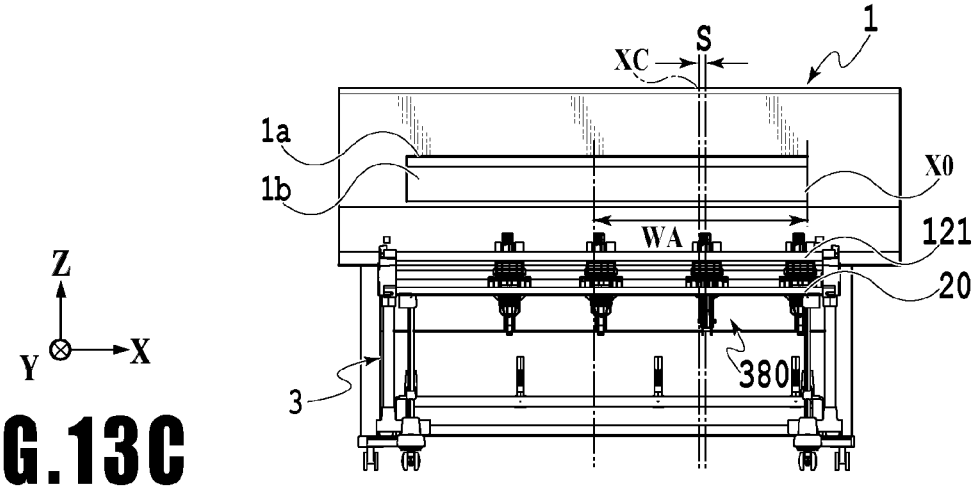

FIG. 13A, FIG. 13B, and FIG. 13C are views illustrating the printing apparatus in a case where the second reception form is selected. Specifically, FIG. 13A is a perspective view of the printing apparatus, FIG. 13B is a side view of the printing apparatus, and FIG. 13C is a front view of the printing apparatus in which the illustration of the receptor 40 is omitted. A second housing form is established by mounting, by a user, the second sheet stopper unit 380 to the stacker 3 of the above-described first housing form. The wire tray 382 on the sheet stopper unit 380 functions to stop the front end of a sheet, which is similar to that of the first sheet abutting member 170.

In the second housing form, a sheet W3 to be discharged from the discharging opening 1*a* is guided downward by the discharging opening guide 1*b*, the flappers 183, and the roll guide unit 370. A front end W3*a* of the sheet W3 abuts the wire tray 382 of the second sheet stopper unit 380 and is stopped. This second sheet stopper unit 380 is, as shown in FIG. 13C, mounted at a position deviated closer to the reference position X0 of the sheet end rather than to the center XC of the width WA of the sheet W3(1) by a predetermined amount S. For instance, in a case where the sheet W3 has an A0 size, the predetermined amount S is 20 mm. After the front end W3*a* of the sheet W3 is stopped by the wire tray 382 as in the state of the sheet W3(1), the discharge of the sheet W3 further continues to form a loop that curves toward a side apart from the body 1 as in the state of sheet W3(2) with the position of the upper rod 121 serving as an inflection point. Then, after the back end W3*b* of the sheet W3 is cut, the sheet W3 is flipped over to the left side in FIG. 13B with the position of the upper rod 121 serving as the inflection point as in the states of sheets W3(3) and W3(4). The sheet W3 is, as shown in FIG. 13B, housed such that the portion between the front end W3*a* and a middle portion of the sheet is disposed within the receptor 40 and that the portion between the middle portion and a back end W3*b* is supported on the receptor 40. Such sheets W3 are continuously discharged to be stacked in order.

In the case where the cutter 6 (see FIG. 1B) cuts the sheet W3 from the reference position X0 side, there may be a concern such that the sheet W3 drops in a slanting direction from the reference position X0 side and are consequently cut diagonally. However, in a position deviated closer to the reference position X0 rather than the center XC of the sheet W3, the second sheet stopper unit 38 supports the front end W3*a* of the sheet W3. Thus, the dropping of the sheet W3 in a slanting direction can be suppressed, and the sheet W3 can be cut with accuracy.

The second reception form is a form suitable for a smaller sized sheet (for example, vertical A1) than the sheet to be housed in the above-described first reception form, and is capable of adopting the face-down stacking with a printed sheet face facing down.

(Third Reception Form)

Figure 14A:
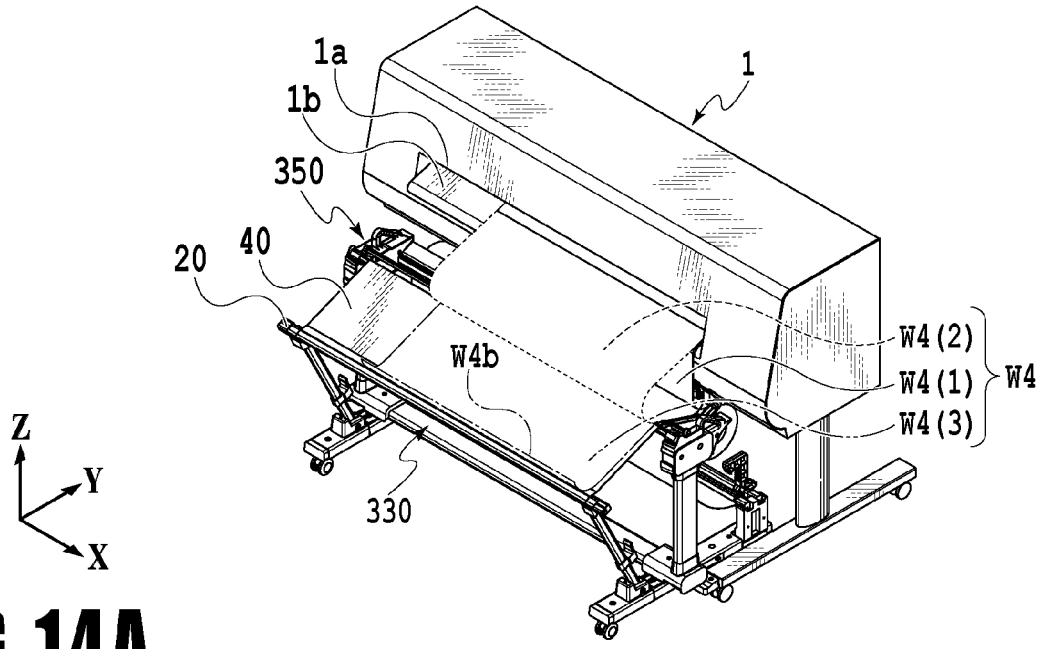
FIGS. 14A, 14B, and 14C are views each illustrating the state of the printing apparatus in the case of selecting a third reception form.
Figure 14B:
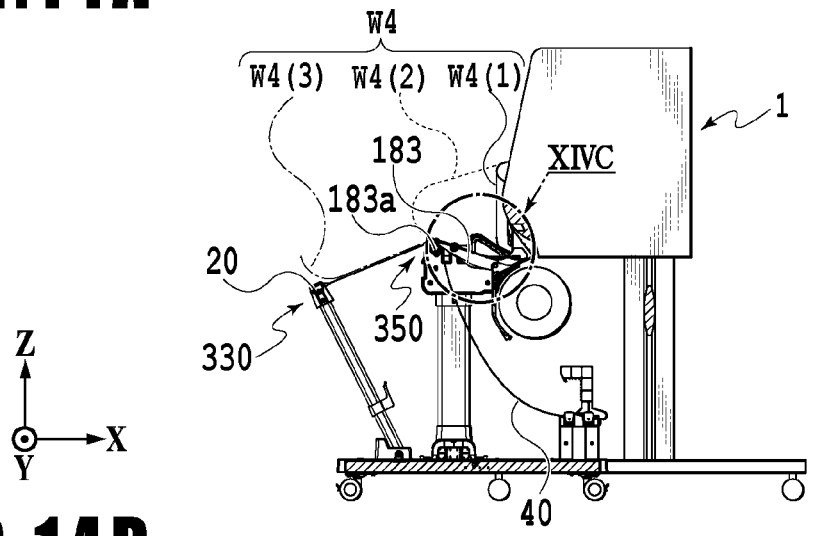
Figure 14C:
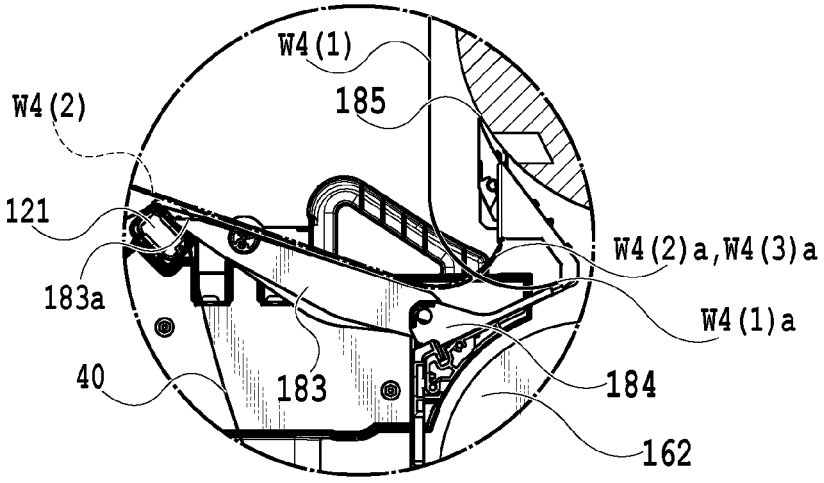

FIG. 14A, FIG. 14B, and FIG. 14C are views illustrating the printing apparatus in a case where the third reception form is selected. Specifically, FIG. 14A is a perspective view of the printing apparatus, FIG. 14B is a side view of the printing apparatus, and FIG. 14C is an enlarged view taken from circle XIVC of FIG. 14B. In the stacker 3 of the above-described first housing form, the flappers 183 are rotated to be at a position for guiding a sheet to be discharged from the discharging opening 1*a* downward. The third housing form is configured such that the flappers 183 are rotated to be at a position for supporting a sheet, and in this regard, is different from the first housing form.

As the flappers 183 rotate to the position for supporting a sheet, the clearance V2 between the first roll guide 371 and the receptor 40 shown in FIG. 12B, that is, a path that leads the sheet downward is blocked. As shown in FIG. 14C, the tip end 183*a* of the flapper 183 abuts the upper rod 121 of the upper rod unit via the receptor 40. The upper face of the flapper 183 is inclined toward the upper left side in FIG. 14C, and the receptor 40 between the upper rod 121 and the front rod 20 is inclined toward the lower left side in FIG. 14B.

In the third reception form, a printed sheet W4 discharged from the discharging opening 1*a* is firstly guided downward by the discharging opening guide 1*b* and the sheet guides 185 as in the state of a sheet W4(1), and the front end W4(1)*a* abuts the recesses of the guides 184 and is stopped. The discharge of the sheet W4 further continues to form a loop that curves toward a side apart from the body 1 as in the state of a sheet W4(2) with the position of the front rod 20 serving as an inflection point. Then, after the back end W4*b* of the sheet W4 is cut, the sheet W4 is flipped over to the left side in FIG. 14B with the position of the upper rod 121 serving as an inflection point as in the state of a sheet W4(3). A portion of the front end side of the sheet W4 is supported on the upper faces of the flappers 183, and a portion of the back end side is supported on the receptor 40 between the upper rod 121 and the front rod 20. The front ends W4(2)*a* and W4(3)*a* of sheets W4(2) and W4(3) are disposed within the recesses of the guides 184 as shown in FIG. 14C. Such sheets W4 are continuously discharged to be stacked in order.

The third housing form is a form suitable for a smaller sized sheet (for example, lateral A1 and lateral A2) than sheets to be housed in the above-described first and second reception forms, and is capable of adopting the face-down stacking with a printed sheet face facing down.

(Fourth Reception Form)

Figure 15A:
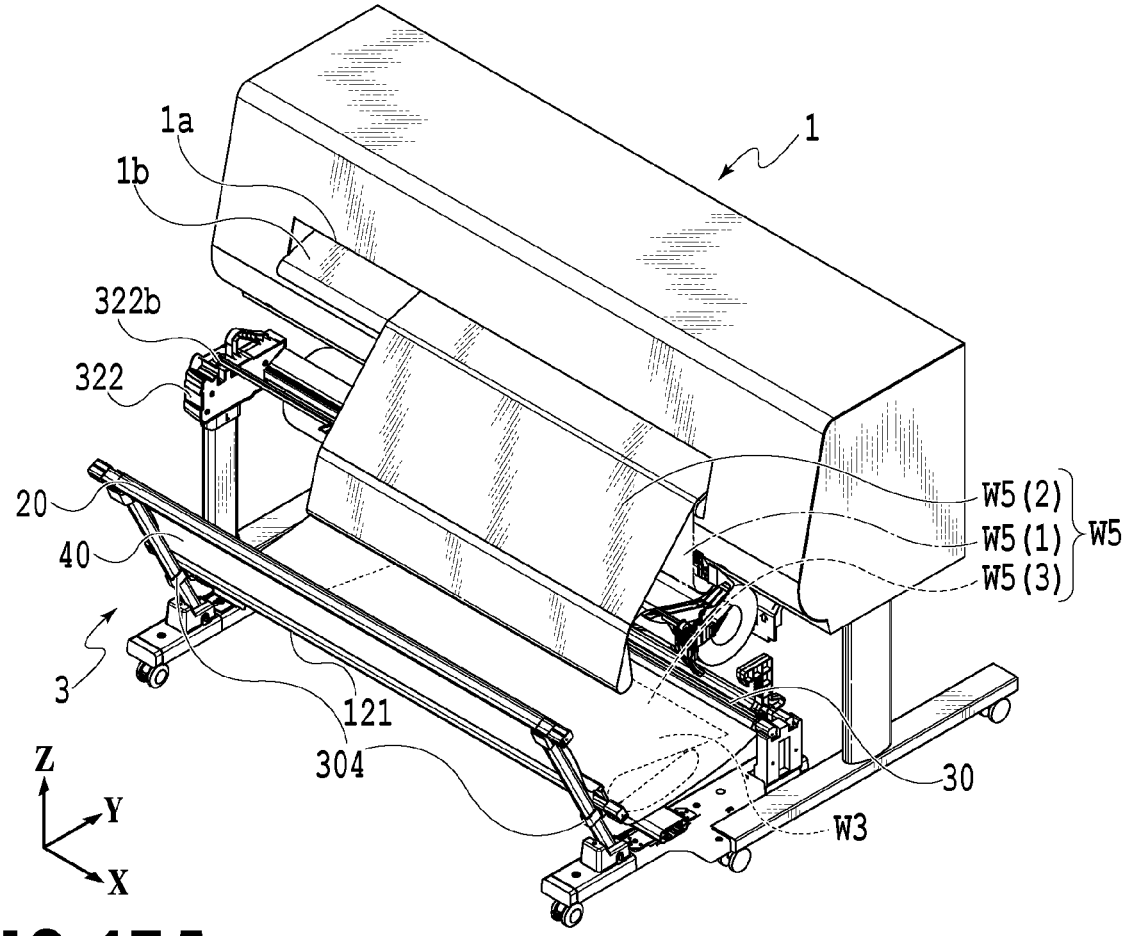
FIGS. 15A and 15B are views each illustrating the state of the printing apparatus in the case of selecting a fourth reception form.
Figure 15B:
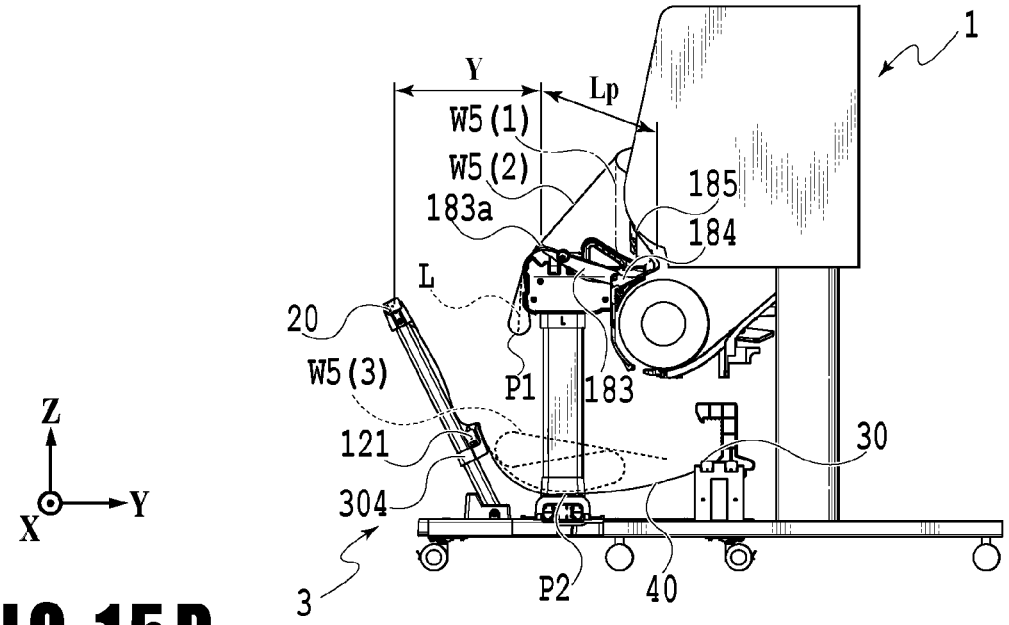

FIG. 15A and FIG. 15B are views illustrating the printing apparatus in a case where the fourth reception form is selected. Specifically, FIG. 15A is a perspective view of the printing apparatus and FIG. 15B is a side view of the printing apparatus. In FIG. 15A, for the convenience of explanation, the illustration of components on the right side of FIG. 15A in the stacker 3 is omitted.

The upper rod 121 is positioned above the right and left upper rod bases 322 in the third reception form, but is moved above the rod holders 304 in the fourth reception form. In this regard, the fourth reception form is different from the third reception form. The flexible receptor 40 is curved, by its own weight, so as to sag downward to form a bag shape capable of receiving the entire sheet. Further, a bottom point P2 is disposed lower than the rear rod 30. The receptor 40 forms a large housing space in the depth direction thereof (the lateral direction in FIG. 15B). The flappers 183 are rotated to be at a position to support a sheet, which is similar to the third housing form, and are disposed so as to be protruded obliquely upward from the right side of FIG. 15B to the left side thereof. The receptor 40 is formed to have a large sheet housing part so as to include an area disposed below the flappers 183.

In the fourth reception form, as in the third reception form, a sheet W5 discharged from the discharging opening 1*a* is guided downward by the discharging opening guide 1*b* and the sheet guides 185, as in the state of the sheet W5(1), and the front end abuts the recesses of the guides 184 and is stopped. A portion of the front end side of the sheet W5 is supported in an area Lp above the guides 184 and the flappers 183. As the discharge of the sheet W5 further continues, a loop that leads downward is formed, as in the state of sheet W5(2), with the position of the tip end 183*a* (see FIG. 14C) of the flapper 183 serving as an inflection point. As a result, the subsequent portion of the sheet W5 is hung down within a housing space without contacting other members such as the receptor 40. Then, after the back end of the sheet W5 is cut, as in the state of sheet W5(3), the sheet is dropped within the bag-shaped receptor 40 from an opening area Y to be housed therein in a gently folded state.

As for the sheet W5 before being cut, the portion of the front end side is disposed above a range extending from the guides 184 to the flappers 183, and the portion of the back end side is retained by the body 1. The sheet W5 after being cut is dropped onto the receptor 40 to be housed and placed thereon. Since the portion of the back end side of the sheet W5 before being cut is held by the body 1, the center of gravity of the sheet W5 is disposed on the body 1 side (the right side in FIG. 15B) rather than on the tip ends 183*a* of the flappers 183. Accordingly, the sheet W5 is not dropped even in the state of forming a loop being hung with the tip end 183*a* serving as an inflection point, and the portion of the front end side is disposed above the range extending from the guides 184 to the flappers 183. In the case where the sheet W5 is cut and the portion of the back end side is no longer held by the body 1, the center of gravity of the sheet W5 shifts to a side apart from the body 1 (the left side in FIG. 15B) rather than the tip ends 183*a* of the flappers 183. Accordingly, the cut sheet W5 is dropped, by its own weight, within the receptor 40 from the vicinity of the middle of a loop-shaped portion, and is housed in the gently folded state while keeping the loop shape. Such sheets W5 are continuously discharged to be stacked in order.

As such, in the fourth housing form, as the upper rod 121 is shifted on the rod holders 304, the receptor 40 forms a large bag-like housing part in the area including the lower position of the flappers 183. As the loop-shaped portion of the sheet W5 that is hung from the tip ends 183*a* of the flappers 183 can be formed without being interfered by other members, the sheet W5 is cut and is dropped to be gently folded while keeping the loop shape. Therefore, the sheets W5 to be continuously housed are stacked in the gently folded state. Since the sheet W5 is housed with the receptor 40 being at a low position, the large number of sheets W5 can be housed by effectively using a space within the stacker 3 in its height direction for the housing space of the sheets W5. In addition, those sheets can be securely housed irrespective of the curling degree and length of the sheet W5.

As for the sheet W5 to be housed in the fourth reception form, plain paper and coated paper often used for drawings and posters having standard-sized sheets such as A0 size and B0 size are mainly assumed. However, it is not limited to those standard-sized sheets, and a plurality of sizes of sheets may be simultaneously housed.

In the fourth reception form, it is preferable that the bottom point P2 of the receptor 40 be disposed on the body 1 side (the right side in FIG. 15B) rather than a lower end P1 of the loop-shape portion of the sheet W5 that is hung from the tip ends 183*a*. Alternatively, the bottom point P2 may be disposed on a side apart from the body 1 (the left side in FIG. 15B) rather than the lower end P1. In any case, it is desirable that the inner face of the receptor 40 at the lower position of the lower end P1 be inclined depending on the positional relation between the bottom point P2 and the lower end P1. By using the inclined face formed on the receptor 40, a sheet which is dropped while keeping the loop shape is gently folded by making effective use of the loop shape.

OTHER EMBODIMENTS

The present invention is applicable not only to the printing apparatus but also to a sheet processing apparatus which performs various processing to a sheet. The sheet is not limited only to the form wound in a roll shape, but may be a sheet that has been cut in a predetermined length beforehand or may be a sheet made of any materials other than paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-095406 filed May 12, 2017, which is hereby incorporated by reference wherein in its entirety.

What is claimed is:

1. A printing apparatus comprising:

a printing unit configured to perform printing on a sheet and discharge a printed sheet;

a pair of body-side feet for supporting the printing unit, having first inner side faces opposing each other, the body-side feet being disposed on both sides, in a width direction of a sheet, of the printing unit;

a sheet housing unit configured to house the sheet to be discharged from the printing unit;

a pair of housing-side feet for supporting the sheet housing unit, the housing-side feet being disposed on both sides, in the width direction, of the sheet housing unit; and a pair of housing-side legs having second inner side faces opposing each other, the pair of housing-side legs being disposed, respectively, on the pair of housing-side feet, wherein, when the sheet housing unit houses the sheet being discharged from the printing unit, each housing-side foot of the sheet housing unit is arranged at a position inside a corresponding one of the body-side feet that is on the same side as the housing-side foot in the width direction, and the second inner side face of at least one housing-side leg is disposed outside of the first inner side face of the same side of the body-side foot in the width direction.

2. The printing apparatus according to claim 1, wherein an interval between the pair of housing-side legs is greater than an interval between the pair of housing-side feet.

3. The printing apparatus according to claim 1, wherein each second inner side face of each housing-side leg is disposed outside each first inner side face of the body-side foot on the same side in the width direction.

4. The printing apparatus according to claim 1, wherein the printing unit has a discharge port for discharging the printed sheet, and wherein the sheet housing unit includes an abutting member for receiving a tip of the sheet discharged from the discharge port, the abutting member arranged lower than the discharge port and closer to a back side of the printing unit than the discharge port.

5. The printing apparatus according to claim 4, wherein the printing apparatus includes a holding unit for holding the sheet being supplied to the printing unit, the holding unit being disposed lower than the discharge port and higher than the abutting member.

6. The printing apparatus according to claim 1, wherein the sheet housing unit houses the sheet discharged from the printing unit between the second inner side faces opposing the pair of housing-side legs.

7. The printing apparatus according to claim 1, wherein the sheet housing unit includes a receptor stacking the sheet discharged from the printing unit.

8. The printing apparatus according to claim 7, wherein a part of the receptor is supported in an upper portion of the pair of housing-side legs.

9. The printing apparatus according to claim 1, wherein the sheet housing unit is capable of being separated from the printing apparatus, and when the sheet housing unit is combined with the printing apparatus, the pair of body-side feet is combined with the pair of housing-side feet on the same side in the width direction.

10. A sheet housing apparatus capable of being combined with a printer, the printer including a printing unit configured to perform printing on a sheet and discharge a printed sheet from the printing unit, and a pair of body-side feet for supporting the printing unit, the pair of body-side feet having first inner side faces opposing each other, the pair of body-side feet being disposed on both sides, in a width direction of a sheet to be discharged from the printing unit, of the printer, the sheet housing apparatus comprising:

a housing unit for housing the sheet to be discharged from the printing unit;

a pair of housing-side feet for supporting the housing unit, the housing-side feet being disposed on both sides, in the width direction, of the housing unit; and a pair of housing-side legs having second inner side faces opposing each other, the pair of housing-side legs being disposed, respectively, on the pair of housing-side feet, wherein, when the housing unit houses the sheet being discharged from the printing unit, each housing-side foot of the sheet housing apparatus is arranged at a position inside a corresponding one of the body-side feet that is on the same side as the housing-side foot in the width direction, and the second inner side face of at least one housing-side leg is disposed outside of the first inner side face of the same side of the body-side foot in the width direction.

11. The sheet housing apparatus according to claim 10, wherein an interval between the pair of housing-side legs is greater than an interval between the pair of housing-side feet.

12. The sheet housing apparatus according to claim 10, wherein each second inner side face of each housing-side leg is disposed outside each first inner side face of the same side of the body-side foot in the width direction.

13. The sheet housing apparatus according to claim 10, wherein the printer has a discharge port for discharging the printed sheet, and wherein the housing unit includes an abutting member for receiving a tip of the sheet discharged from the discharge port, the abutting member arranged lower than the discharge port and closer to a back side of the printer than the discharge port.

14. The sheet housing apparatus according to claim 13, wherein the printer includes a holding unit for holding the sheet being supplied to the printing unit, the holding unit being disposed lower than the discharge port and higher than the abutting member.

15. The sheet housing apparatus according to claim 10, wherein the housing unit houses the sheet discharged from the printing unit between the second inner side faces opposing the pair of housing-side legs.

16. The sheet housing apparatus according to claim 10, wherein the housing unit includes a receptor stacking the sheet discharged from the printing unit.

17. The sheet housing apparatus according to claim 16, wherein a part of the receptor is supported in an upper portion of the pair of housing-side legs.

18. The sheet housing apparatus according to claim 10, wherein when the sheet housing apparatus is combined with the printer, the pair of body-side feet is combined with the pair of housing-side feet on the same side in the width direction.

* * * * *